US006913549B2

(12) United States Patent
Yagley et al.

(10) Patent No.: US 6,913,549 B2
(45) **Date of Patent: *Jul. 5, 2005**

(54) GOLF BALL WITH HIGH COEFFICIENT OF RESTITUTION

(75) Inventors: Michael S. Yagley, Cardiff, CA (US); Steven S. Ogg, Carlsbad, CA (US); Pijush K. Dewanjee, Carlsbad, CA (US); David M. Bartels, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 21 days.

This patent is subject to a terminal disclaimer.

(21) Appl. No.: 10/708,501

(22) Filed: Mar. 8, 2004

(65) Prior Publication Data

US 2005/0037865 A1 Feb. 17, 2005

Related U.S. Application Data

(60) Continuation-in-part of application No. 10/604,430, filed on Jul. 21, 2003, which is a continuation of application No. 10/063,861, filed on May 20, 2002, now Pat. No. 6,595,872, which is a continuation of application No. 09/682,792, filed on Oct. 19, 2001, now Pat. No. 6,478,697, which is a continuation-in-part of application No. 09/877,651, filed on Jun. 8, 2001, now Pat. No. 6,443,858, which is a continuation-in-part of application No. 09/710,591, filed on Nov. 11, 2000, now Pat. No. 6,422,954, which is a division of application No. 09/361,912, filed on Jul. 27, 1999, now Pat. No. 6,190,268.

(51) Int. Cl.[7] ..... A63B 37/14
(52) U.S. Cl. ..... 473/378
(58) Field of Search ..... 473/378, 383, 473/384

(56) References Cited

U.S. PATENT DOCUMENTS

| | | | |
|---|---|---|---|
| 721,462 | A | 2/1903 | Richards |
| 2,002,726 | A | 5/1935 | Young |
| 2,940,128 | A | 5/1960 | Bowerman et al. |
| 3,034,791 | A | 5/1962 | Gallagher |
| 3,112,521 | A | 12/1963 | Ward |
| 3,130,102 | A | 4/1964 | Watson et al. |
| 3,147,324 | A | 9/1964 | Ward |
| 3,177,280 | A | 4/1965 | Ford et al. |
| 3,277,456 | A | 10/1966 | Sonneman |
| 3,616,101 | A | 10/1971 | Satchell et al. |
| 3,979,126 | A | 9/1976 | Dusbiber |
| 3,989,568 | A | 11/1976 | Isaac |
| 4,062,825 | A | 12/1977 | Satchell et al. |
| 4,090,716 | A | 5/1978 | Martin et al. |
| 4,123,061 | A | 10/1978 | Dusbiber |
| 4,248,432 | A | 2/1981 | Hewitt et al. |
| 4,266,773 | A | 5/1981 | Treadwell |
| 4,274,637 | A | 6/1981 | Molitor |
| 4,321,183 | A | 3/1982 | Cox et al. |
| 4,349,657 | A | 9/1982 | Holloway |
| 4,442,282 | A | 4/1984 | Kolycheck |
| 4,650,193 | A | 3/1987 | Molitor et al. |

(Continued)

*Primary Examiner*—Raeann Gorden
(74) *Attorney, Agent, or Firm*—Michael A. Catania; Elaine H. Lo

(57) ABSTRACT

The present invention is a golf ball that has a coefficient of restitution that is greater than 0.8015 at 143 feet per second, and an USGA initial velocity less than 255.0 feet per second. The golf ball has a solid three-piece golf ball with a polybutadiene core, an ionomer blend intermediate layer, and a thermosetting polyurethane cover, with an aerodynamic surface geometry. The golf ball has an innersphere with a plurality of lattice members interconnected to form a plurality of polygons. Each of the lattice members has apex, such that the golf ball conforms with the USGA's golf ball diameter requirement of 1.680 inches.

25 Claims, 17 Drawing Sheets

U.S. PATENT DOCUMENTS 4,674,751 A 6/1987 Molitor et al.
4,787,638 A 11/1988 Kobayashi
4,830,378 A 5/1989 Aoyama
4,836,552 A 6/1989 Puckett et al.
4,870,142 A 9/1989 Czerwinski et al.
4,878,638 A 11/1989 Kobayashi et al.
5,006,297 A 4/1991 Brown
5,062,644 A 11/1991 Lee
5,064,199 A 11/1991 Morell
5,098,105 A 3/1992 Sullivan
5,143,377 A 9/1992 Oka et al.
5,159,053 A 10/1992 Kolycheck et al.
5,184,828 A 2/1993 Kim et al.
5,209,485 A 5/1993 Nesbitt et al.
5,308,076 A 5/1994 Sun
5,338,039 A 8/1994 Oka et al.
5,356,150 A 10/1994 Lavallee et al.
5,368,304 A 11/1994 Sullivan et al.
5,377,989 A 1/1995 Machin
5,441,276 A 8/1995 Lim
5,470,076 A 11/1995 Cadorniga
5,484,870 A 1/1996 Wu
5,536,013 A 7/1996 Pocklington
5,575,477 A 11/1996 Hwang
5,682,230 A 10/1997 Anfinsen et al.
5,688,191 A 11/1997 Cavallaro et al.
5,692,974 A 12/1997 Wu et al.
5,703,193 A 12/1997 Rosenberg et al.
5,722,903 A 3/1998 Moriyama et al.
5,733,428 A 3/1998 Calabria et al.
5,779,562 A 7/1998 Melvin et al.
5,797,808 A 8/1998 Hayashi et al.
5,803,831 A 9/1998 Sullivan et al.
5,813,923 A 9/1998 Caballaro et al.
5,816,940 A 10/1998 Hayashi et al.
5,824,746 A 10/1998 Harris et al.
5,830,085 A 11/1998 Higuchi et al.
5,830,087 A 11/1998 Sullivan et al.
5,857,924 A 1/1999 Miyagawa et al.
5,863,264 A 1/1999 Yamagishi et al.
D406,623 S 3/1999 Stiefel
5,885,172 A 3/1999 Hebert et al.
5,888,437 A 3/1999 Calabria et al.
5,890,975 A 4/1999 Stiefel
5,906,551 A 5/1999 Kasashima et al.
5,908,358 A 6/1999 Wu
5,908,359 A 6/1999 Shimosaka et al.
5,916,044 A 6/1999 Shimosaka et al.
5,929,189 A 7/1999 Ichikawa et al.
5,935,021 A 8/1999 Kashiwagi et al.
5,935,023 A 8/1999 Maehara et al.
5,947,843 A 9/1999 Calabria et al.
5,961,401 A 10/1999 Masutani et al.
5,965,669 A 10/1999 Cavallaro et al.
5,971,870 A 10/1999 Sullivan et al.
5,974,806 A 11/1999 Sullivan et al.
5,981,658 A 11/1999 Rajagopalan et al.
5,993,968 A 11/1999 Umazawa et al.
6,015,356 A 1/2000 Sullivan et al.
6,037,419 A 3/2000 Takesue et al.
6,042,488 A 3/2000 Sullivan et al.
6,042,768 A 3/2000 Calabria et al.
6,054,550 A 4/2000 Umazawa et al.
6,057,403 A 5/2000 Sullivan et al.
6,126,558 A 10/2000 Higuchi et al.
6,213,892 B1 4/2001 Felker et al.
6,290,615 B1 9/2001 Ogg
D449,358 S 10/2001 Ogg
6,309,313 B1 10/2001 Peter
6,595,872 B2 * 7/2003 Yagley et al. ..... 473/371
2003/0027668 A1 * 2/2003 Ogg et al. ..... 473/378

* cited by examiner

GOLF BALL WITH HIGH COEFFICIENT OF RESTITUTION

CROSS REFERENCE TO RELATED APPLICATIONS

The present application is a continuation-in-part of U.S. patent application Ser. No. 10/604,430, filed on Jul. 21, 2003, which is a continuation of U.S. patent application Ser. No. 10/063,861, filed on May 20, 2002, now U.S. Pat. No. 6,595,872, which is a continuation of U.S. patent application Ser. No. 09/682,792 filed on Oct. 19, 2001, now U.S. Pat. No. 6,478,697, which is a continuation-in-part of U.S. patent application Ser. No. 09/877,651 filed on Jun. 8, 2001, now U.S. Pat. No. 6,443,858, which is a continuation-in-part of U.S. patent application Ser. No. 09/710,591 filed on Nov. 11, 2000, now U.S. Pat. No. 6,422,954, which is a divisional of U.S. patent application Ser. No. 09/361,912 filed on Jul. 27, 1999, now U.S. Pat. No. 6,190,268.

FEDERAL RESEARCH STATEMENT

[Not Applicable]

BACKGROUND OF INVENTION

1. Field of the Invention

The present invention relates to a golf ball. More specifically, the present invention relates to a solid three-piece golf ball with an aerodynamic surface geometry, a relatively thin cover, a high core compression, a high cover hardness and an initial velocity limited to less than 255 feet per second.

2. Description of the Related Art

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf, as set forth by the United States Golf Association ("USGA") and The Royal and Ancient Golf Club of Saint Andrews ("R&A"), which have placed controls on the construction and performance of golf balls. As set forth in Appendix III of the Rules of Golf, the weight of the ball shall not be greater than 1.620 ounces avoirdupois (45.93 g), and the diameter of the ball shall not be less than 1.680 inches (42.67 mm), which is satisfied if, under its own weight, a ball falls through a 1.680 inches diameter ring gauge in fewer than 25 out of 100 randomly selected positions, the test being carried out at a temperature of 23±1° C. In addition, the ball must not be designed, manufactured or intentionally modified to have properties, which differ from those of a spherically symmetrical ball.

One example is Shimosaka et al., U.S. Pat. No. 5,916,044, for a Golf Ball that discloses the use of protrusions to meet the 1.68 inches (42.67 mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378 for a Golf Ball with Uniform Land Configuration, discloses a golf ball with dimples that have triangular shapes. The total flat land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball and Method of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. D406,623 has all elongated dimples.

A variation on this theme is set forth in Moriyama et al., U.S. Pat. No. 5,722,903 for a Golf Ball, which discloses a golf ball with traditional dimples and oval shaped dimples.

A further example of a non-traditional golf ball is set forth in Shaw et al., U.S. Pat. No. 4,722,529 for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076 for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377 for a Golf Ball, discloses circular and non-circular dimples are square, regular octagonal, regular hexagonal and amount to at least forty percent of the 332 dimples on the golf ball of Oka. These non-circular dimples of Oka have a double slope that sweeps air away from the periphery in order to make the air turbulent.

Machin, U.S. Pat. No. 5,377,989 for Golf Balls with Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

The golf ball rules further require that a golf ball have an overall distance no greater than 296.8 yds (the limit is 280 yds, or 256 m, plus a six percent tolerance for the total distance of 296.8 yds) and an initial velocity no greater than 255.0 ft/s (the limit is 250 ft/s or 76.2 m/s, with a two percent maximum tolerance that allows for an initial velocity of 255 ft/s) measured on a USGA approved apparatus.

The initial velocity test for conformance is comprised of a large 275 pound wheel that rotates around a central axis at a rate of 143.8 feet per second (striker tangential velocity) and strikes a stationary golf ball resting on a tee. The wheel has a flat plate that protrudes during its final revolution prior to impact with the golf ball. The ball's velocity is then measured via light gates as it travels approximately six feet through an enclosed tunnel. Balls are kept in an incubator at a constant temperature of 23 degrees Celsius for at least three hours before they are tested for initial velocity performance. To test for initial velocity, balls are placed on a tee and hit with the metal striker described above. Twenty-four balls of a particular type make up one test. Each ball is hit with the spinning wheel a total of four times. The highest and lowest recorded velocities are eliminated and the remaining two velocities are averaged to determine the ball speed for that specific ball. The individual speeds of the 24 balls in the group are then averaged, and that is considered the mean initial velocity (IV) of the group for the test.

For USGA conformance purposes, a ball with a mean initial velocity of less than 255.0 ft/s is considered conforming to the USGA Rule of Golf and can be played in sanctioned events. For reference to the USGA Wheel Test see the USGA web-site at www.usga.com, or reference U.S. Pat. No. 5,682,230 for further information.

Generally speaking, the USGA IV test is designed to be a consistent measurement tool capable of regulating the speed (and ultimately distance) of golf balls. It is commonly known in the industry that golf ball manufacturers perform a simpler test on prototype golf balls and then attempt to correlate the results to the USGA Wheel Test. One type of correlation test is the Coefficient of Restitution ("COR") test, which consists of firing a golf ball from a cannon into a fixed plate and taking the ratio of outgoing velocity to incoming velocity.

The Coefficient of Restitution is the ratio of the velocity of separation ($V_{out1}-V_{out2}$) to the velocity of approach ($V_{in1}-V_{in2}$), where $COR=(V_{out1}-V_{out2})/(V_{in1}-V_{in2})$. The value of COR will depend on the shape and material properties of the colliding bodies. In elastic impact, the COR is unity and there is no energy loss. A COR of zero indicates perfectly inelastic or plastic impact, where there is no separation of the bodies after collision and the energy loss is a maximum. In oblique impact, the COR applies only to those components of velocity along the line of impact or normal to the plane of impact. The coefficient of restitution between two materials can be measured by making one body many times larger than the other so that $m_2$ (mass of larger body) is infinitely large in comparison to $m_1$ (mass of the smaller body). The velocity of $m_2$ is unchanged for all practical purposes during impact and $$COR=V_{out}/V_{in}$$

One particular type of COR test device that is commonly used in the golf ball industry is the ADC COR machine developed by Automated Design Corporation. Based on the definition of COR above, $m_2$ is a large 400 lb plate fixed vertically that the ball ($m_1$) is fired into. The impact of the golf ball to the large fixed plate is an oblique impact. Software developed by Automated Design Corporation accurately calculates the normal velocities given the dimensions of the machine and outputs a value for Coefficient of Restitution as defined above.

U.S. Pat. No. 5,209,485, filed in 1991, discloses a restricted flight golf ball that has a reduced COR. However, the '485 patent also discloses, for comparison purposes, that the TOP FLITE®XL golf balls, manufactured and sold by Spalding had a COR value of 0.813 when fired at a speed of 125 ft/s. The '485 patent also discloses that the Spalding SUPER RANGE golf ball had a COR value of 0.817 when fired at a speed of 125 ft/s. However, the SUPER RANGE golf ball was a non-conforming golf ball and thus had an IV value greater than 255 ft/s.

U.S. Pat. No. 5,803,831, filed in 1996 discloses in Table 14 a finished solid three-piece golf ball that has a COR of 0.784 at a speed of what is believed to be 125 ft/s.

Although the prior art has set forth numerous variations for the surface of a golf ball, the prior art golf balls fail to provide an aerodynamic golf ball with a surface that minimizes the volume needed to trip the boundary layer of air at low speeds while providing a low drag level at high speeds and that conforms to the USGA IV limit of 255 feet per second while having a high COR.

SUMMARY OF INVENTION

The present invention provides a solution to the problem of adhering to the USGA initial velocity limit of 255 feet per second for a golf ball while increasing the distance a golf ball travels when struck with a golf club. The solution is a solid three-piece golf ball with a high PGA compression core, a thin cover and an aerodynamic surface geometry that adheres to the USGA initial velocity limit.

One aspect of the present invention is a golf ball including a core composed of a polybutadiene blend, an intermediate layer, a cover, and an innersphere with a plurality of lattice members forming a predetermined pattern of polygons. The golf ball has a ball Shore D hardness ranging from 45 points to 75 points as measured on the surface of the golf ball, a coefficient of restitution greater than 0.7964 at 143 feet per second, and an USGA initial velocity less than 255.0 feet per second.

Another aspect of the invention is a golf ball that includes a core composed of a polybutadiene blend, an intermediate layer composed of a thermoplastic material, a cover composed of a thermosetting polyurethane material, and an innersphere with a plurality of lattice members forming a predetermined pattern of polygons. The golf ball has a ball Shore D hardness ranging from 45 points to 75 points as measured on the surface of the golf ball, a coefficient of restitution greater than 0.7964 at 143 feet per second, and an USGA initial velocity less than 255.0 feet per second. The core has a PGA compression ranging from 75 points to 120 points. The intermediate layer has a Shore D hardness ranging from 50 points to 75 points as measured on the surface of the intermediate layer.

Yet another aspect of the present invention is a golf ball that includes a solid core composed of a polybutadiene blend, an intermediate layer composed of an ionomer material, a cover composed of a polyurethane material, and an innersphere with a plurality of lattice members forming a predetermined pattern of polygons. The solid core has a PGA compression ranging from 75 points to 120 points, a diameter ranging from 1.35 inches to 1.64 inches, and a mass ranging from 32 grams to 40 grams. The intermediate layer has a Shore D hardness ranging from 55 points to 75 points as measured on the curved surface of the intermediate layer. The cover has a thickness ranging from 0.015 inch to 0.044 inch. The golf ball has a coefficient of restitution greater than 0.7964 at 143 feet per second, and an USGA initial velocity less than 255.0 feet per second. The golf ball also has a ball Shore D hardness ranging from 50 points to 75 points as measured on the surface of the golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
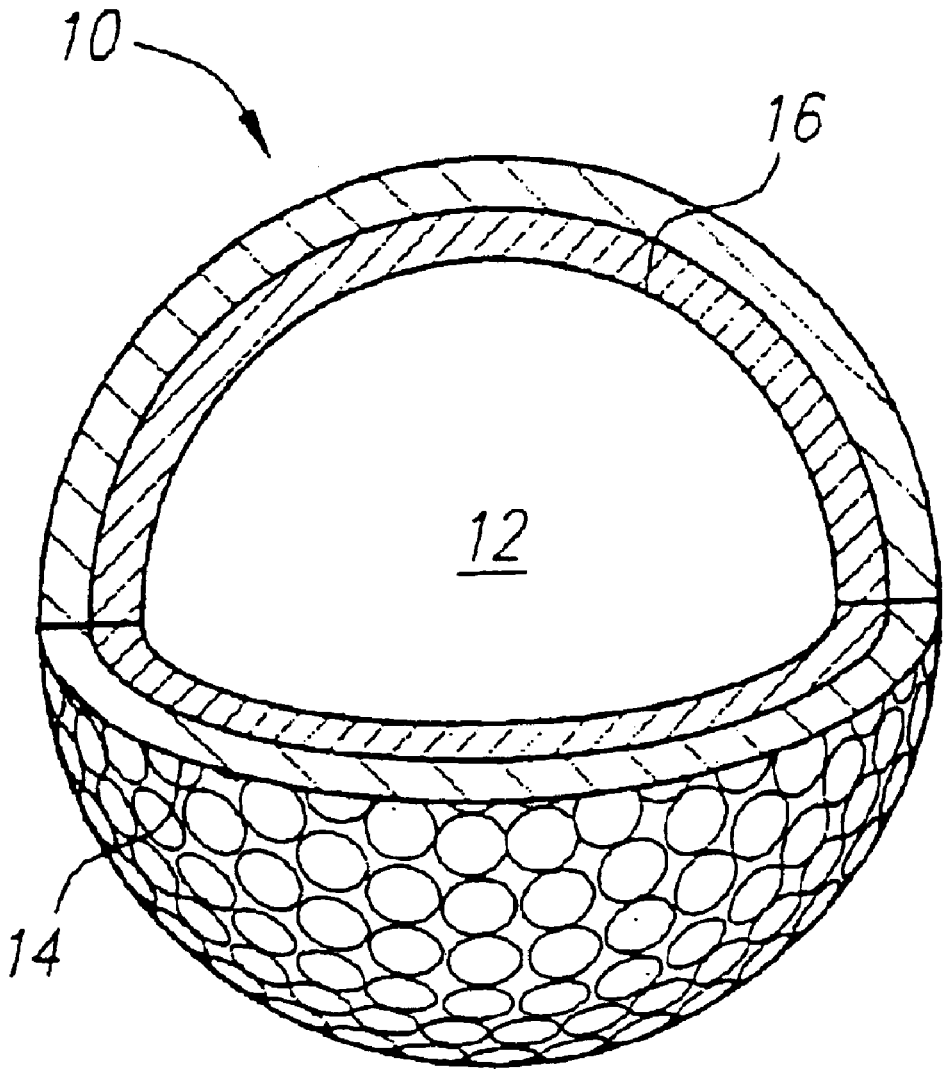
FIG. 1 is a cross-sectional view of a solid three-piece golf ball.

As shown in FIG. 1, a golf ball of the present invention is generally designated 10. The golf ball 10 has a coefficient of restitution greater than 0.7964 at 143 feet per second, and an USGA initial velocity less than 255.0 feet per second. The golf ball of FIG. 1 is a solid three-piece golf ball 10 having a core 12, a cover 14 and an intermediate layer 16. Those skilled in the pertinent art, however, will recognize that other golf balls may be utilized without departing from the scope and spirit of the present invention.

The surface geometry of the golf ball 10 is a non-dimple surface geometry and will be described in greater detail below.

The golf ball 10 is finished with either a very thin (microns in thickness) single top coating, or is painted with one or more base coats of paint, typically white, before application of a clear coat. The material of the cover 14 may be doped for coloring, as is well known in the art.

The core 12 of the golf ball 10 is the "engine" for the golf ball 10 such that the inherent properties of the core 12 will strongly determine the initial velocity and distance of the golf ball 10. A higher initial velocity will usually result in a greater overall distance for a golf ball. However, the initial velocity and overall distance of a golf ball must not exceed the USGA and R&A limits in order to conform to the Rules of Golf. Therefore, the core 12 for a USGA approved golf ball is constructed to enable the golf ball 10 to meet, yet not exceed, these limits.

The COR is a measure of the resilience of a golf ball. A golf ball having a COR value closer to 1 will generally correspond to a golf ball having a higher initial velocity and a greater overall distance. In general, a higher compression core will result in a higher COR value.

The core 12 of the golf ball 10 is generally composed of a blend of a base rubber, a cross-linking agent, a free radical initiator, and one or more fillers or processing aids. A preferred base rubber is a polybutadiene having a cis-1,4 content above 90%, and more preferably 98% or above.

The use of cross-linking agents in a polybutadiene core is well known, and metal acrylate salts are examples of such cross-linking agents. Metal salt diacrylates, dimethacrylates, or mono(meth)acrylates are preferred for use in the core 12 of the golf ball 10 of the present invention, and zinc diacrylate is a particularly preferred cross-linking agent. A commercially available suitable zinc diacrylate is SR-416 available from Sartomer Co., Inc., Exton, Pa. Other metal salt di- or mono- (meth)acrylates suitable for use in the present invention include those in which the metal is calcium or magnesium. In the manufacturing process it may be beneficial to pre-mix some cross-linking agent(s), such as zinc diacrylate with the polybutadiene in a master batch prior to blending with other core components.

Free radical initiators are used to promote cross-linking of the base rubber and the cross-linking agent. Suitable free radical initiators for use in the core 12 of the golf ball 10 of the present invention include peroxides such as dicumyl peroxide, bis-(t-butyl peroxy) diisopropyl benzene, t-butyl perbenzoate, di-t-butyl peroxide, 2,5-dimethyl-2,5-di-5-butylperoxy-hexane, 1,1-di (t-butylperoxy) 3,3,5-trimethyl cyclohexane, and the like, all of which are readily commercially available.

Zinc oxide is also preferably included in the core formulation. Zinc oxide may primarily be used as a weight adjusting filler, and is also believed to participate in the cross-linking of the other components of the core (e.g. as a coagent). Additional processing aids such as dispersants and activators may optionally be included. In particular, zinc stearate may be added as a processing aid (e.g. as an activator). Any of a number of specific gravity adjusting fillers may be included to obtain a preferred total weight of the core 12. Examples of such fillers include tungsten and barium sulfate. All such processing aids and fillers are readily commercially available. The present inventors have found a particularly useful tungsten filler is WP102 Tungsten having a 3 micron particle size) available from Atlantic Equipment, Bergenfield, N.J.

Table One below provides the ranges of materials included in the preferred core formulations of the present invention.

TABLE ONE

| Core Formulation | | |
|---|---|---|
| Component | Preferred Range | Most Preferred Range |
| Polybutadiene | 100 parts | 100 parts |
| Zinc diacrylate | 20–35 phr | 25–30 phr |
| Zinc oxide | 0–50 phr | 5–15 phr |
| Zinc stearate | 0–15 phr | 1–10 phr |
| Peroxide | 0.2–2.5 phr | 0.5–1.5 phr |
| Filler | As desired | As desired |
| (e.g. tungsten) | (2–14 phr) | (10 phr) |

In the present invention, the core components are mixed and compression molded in a conventional manner known to those skilled in the art. The finished core 12 preferably has a diameter of about 1.35 to about 1.64 inches for a golf ball 10 having an outer diameter of 1.68 inches, more preferably a diameter of 1.45 inches to 1.55 inches, and most preferably a diameter ranging from 1.49 inch to 1.515 inch. The core weight is preferably maintained in the range of about 32 grams to about 40 grams. The core PGA compression is preferably maintained in the range of about 75 points to 120 points, most preferably about 90 points to 110 points, and the most preferred is a PGA compression of 90 or 100 points.

As used herein, the term "PGA compression" is defined as follows:

PGA compression value=180−Riehle compression value

The Riehle compression value is the amount of deformation of a golf ball in inches under a static load of 200 pounds, multiplied by 1000. Accordingly, for a deformation of 0.095 inches under a load of 200 pounds, the Riehle compression value is 95 and the PGA compression value is 85.

In a preferred embodiment, the cover 14 is composed of a thermosetting polyurethane material. Preferably the thermosetting polyurethane material is formed from a blend of polyurethane prepolymers and curing agents such as disclosed in U.S. Pat. No. 6,190,268, which is hereby incorporated by reference in its entirety. However, in an alternative embodiment, the cover 14 is composed of a blend of ionomers, as discussed below in reference to the intermediate layer 16.

The intermediate layer 16 is preferably composed of a thermoplastic material or a blend of thermoplastic materials (e.g. metal containing, non-metal containing or both). Most preferably the intermediate layer 16 is composed of at least one thermoplastic material that contains organic chain molecules and metal ions. The metal ion is sodium, zinc, magnesium, lithium, potassium, cesium, or any polar metal ion that serves as a reversible cross-linking site and results in high levels of resilience and impact resistance. Suitable commercially available thermoplastic materials are ionomers based on ethylene copolymers and containing carboxylic acid groups with metal ions such as described above. The acid levels in such suitable ionomers may be neutralized to control resiliency, impact resistance and other like properties. In addition, other fillers with ionomer carriers may be used to modify the specific gravity of the thermoplastic material blend to adjust the moment of inertia and other like properties. Exemplary commercially available thermoplastic materials suitable for use in an intermediate layer 16 of a golf ball 10 of the present invention include, for example, the following materials and/or blends of the following materials: HYTREL® and/or HYLENE® products from DuPont, Wilmington, Del., PEBAX® products from Elf Atochem, Philadelphia, Pa., SURLYN® products from DuPont, and/or ESCOR® or IOTEK® products from Exxon Chemical, Houston, Tex.

The Shore D hardness of the intermediate layer 16 is preferably 50 to 75. It is preferred that the intermediate layer 16 has a hardness of between about 65–70 Shore D. In a preferred embodiment, the intermediate layer 16 has a Shore D hardness of about 68. It is also preferred that the intermediate layer 16 is composed of a blend of SURLYN® ionomer resins.

SURLYN® 8150, 9150, and 6320 are, respectively, an ionomer resin composed of a sodium neutralized ethylene/methacrylic acid, an ionomer resin composed of a zinc neutralized ethylene/methacrylic acid, and an ionomer resin composed of a terpolymer of ethylene, methacrylic acid and n-butyl acrylate partially neutralized with magnesium, all of which are available from DuPont, Polymer Products, Wilmington, Del. It is well known in the art that one may vary the amounts of the different types of resins in order to adjust the hardness of the final material.

The intermediate layer 16 may include a predetermined amount of a baryte mixture. The baryte mixture is included as 8 or 9 parts per hundred parts of the ionomer resins. One preferred baryte mixture is composed of 80% barytes and 20% of an ionomer, and is available from Americhem, Inc., Cuyahoga Falls, Ohio, under the trade designation 38534X1.

A preferred embodiment of the golf ball 10 of the present invention is a solid three-piece golf ball. However, an alternative embodiment has a wound layer between the intermediate layer 16 and the cover 14 such as disclosed in U.S. Pat. No. 6,379,266, filed on Mar. 16, 2000, for a Four Piece Golf Ball, which pertinent parts are hereby incorporated by reference. The core 12 is composed of a polybutadiene blend as described above. The core 12 has a diameter between 1.45 inches and 1.55 inches, and most preferably 1.49 inches. The core 12 has a PGA compression of preferably 90 points or 100 points. The intermediate layer 16 is preferably composed of substantially equal parts of the ionomer resins, SURLYN 8150 and SURLYN 9150, with a range of 40 to 60 parts of SURLYN 8150 to a range of 60 to 40 of SURLYN 9150. The ionomer blend of materials is preferably injection molded over the core to a thickness of between 0.040 inch to 0.080 inch, and most preferably 0.075 inch. The Shore D hardness of the materials of the intermediate layer 16 is preferably between 62 to 75 Shore D as measured according to ASTM D-2290, except the measurement is performed on the curved surface of the intermediate layer 16 by tearing off the cover 14 and using an Instron Shore D Hardness measurement device. The cover 14 is preferably composed of thermosetting polyurethane material, preferably formed from a tri-blend of polyurethane prepolymers and curing agents. The cover 14 is preferably cast over the intermediate layer 16 and core 12, in a casting process such as described in U.S. Pat. No. 6,395,218 for a System and Method for Forming a Thermoset Golf Ball Cover, filed on Feb. 01, 2000 and hereby incorporated by reference. The cover 14 preferably has a thickness of between 0.015 inch to 0.044 inch, and most preferably 0.020 inch. The Shore D hardness of the golf ball 10, as measured on the golf ball is between 55 Shore D points to 70 Shore D points, and most preferably 65 Shore D points. The hardness of the golf ball 10 is measured using an Instron Shore D Hardness measurement device wherein the golf ball 10 is placed within a holder and the pin is lowered to the surface to measure the hardness. The average of five measurements is used in calculating the ball hardness. The ball hardness is preferably measured on a land area of the cover 14.

The overall diameter of the golf ball is approximately 1.68 inches, and the weight is approximately 45.5 grams. Those skilled in the pertinent art will recognize that a golf ball 10 with a larger diameter such as 1.70 inches is within the scope and spirit of the present invention. The preferred golf ball 10 has a COR of approximately 0.8152 at 143 feet per second, and an initial velocity between 250 feet per second to 255 feet per second under USGA initial velocity conditions.

Several golf balls 10 of the present invention were tested for COR against golf balls currently on the market. The balls were kept in an incubator at a constant temperature of 23 degrees Celsius for at least three hours before they were tested for COR performance. To test the COR of a particular ball type, six balls were loaded into a COR machine and fired one at a time through a cannon via compressed air. The test begins by firing the first balls at approximately 80 feet per second, and ends with the last ball firing approximately 180 feet per second. Each of the six balls is fired eight times for a combined 48 shots over the range of speeds between 80–180 feet per second.

To determine the COR of a golf ball at any specific incoming velocity, a third-order polynomial curve is fit through the 48 data points and constrained at the origin. This polynomial fit is extremely accurate (with an R^2 fit value greater than 0.999) and allows the COR to be determined at an exact speed of 143 fps without actually having to achieve that specific cannon velocity. The COR is then obtained by plugging in 143 into the third-order polynomial equation and taking the ratio of outgoing velocity to incoming velocity to calculate the coefficient of restitution. For reference to the ADC COR machine see Automated Design Corporation web-site at www.automateddesign.com.

Table Two illustrates the results of COR testing of commercially available golf balls. The Callaway Golf RULE 35® golf balls (FIRMFEEL and SOFTFEEL), the Titleist PRO V1 392, Nike TOUR ACCURACY, Spalding STRATA TOUR PROFESSIONAL, and the Bridgestone BIIM, are all solid three-piece golf balls. The Maxfli REVOLUTION and the Titleist PROFESSIONAL are both wound golf balls. The other golf balls are two-piece golf balls. All of the non-two-piece golf balls had a COR below 0.797 at a speed of 143 fps, and all of the golf balls of Table Two had a COR below 0.802 at speed of 143 fps. Only the Callaway Golf RULE 35® golf balls (FIRMFEEL and SOFTFEEL) and the Titleist PRO V1 golf balls have a cover thickness below 0.044 inch.

TABLE TWO

| Ball | # Covers | # Dimples | Ball Size (inches) | Core Size (inches) | Ball Comp. (PGA) | Shore D Hardness | COR @ 143 fps |
|---|---|---|---|---|---|---|---|
| Callaway Rule 35 Firmfeel | 2 | 382 | 1.680 | 1.515 | 99 | 57 | 0.7782 |
| Callaway Rule 35 Softfeel | 2 | 382 | 1.680 | 1.489 | 90 | 54 | 0.7895 |
| Titleist Pro V1 392 | 2 | 392 | 1.683 | 1.550 | 89 | 63 | 0.7822 |
| Titleist Professional | 1 | 392 | 1.680 | N/A | 93 | 56 | 0.7735 |
| Strata Tour Professional | 2 | 422 | 1.683 | 1.480 | 94 | 46 | 0.7886 |
| Nike Tour Accuracy | 2 | 392 | 1.682 | 1.439 | 90 | 49 | 0.7830 |
| Maxfli Revolution | 1 | 432 | 1.680 | 1.340 | 89 | 54 | 0.7781 |
| Bridgestone B::M | 2 | 432 | 1.682 | 1.287 | 99 | 68 | 0.7964 |
| Titleist HP Tour | 1 | 416 | 1.683 | 1.590 | 83 | 61 | 0.7713 |
| Titleist DT Distance | 1 | 392 | 1.681 | 1.580 | 95 | 70 | 0.7930 |
| Pinnacle Ti Extreme | 1 | 392 | 1.682 | 1.496 | 114 | 68 | 0.7976 |
| Wilson Smart Core Straight Distance | 1 | 432 | 1.679 | 1.509 | 89 | 71 | 0.8001 |
| Top Flite 2000 Extra Long | 1 | 422 | 1.681 | 1.529 | 92 | 72 | 0.7882 |
| Precept MC Spin 392 | 1 | 392 | 1.684 | 1.537 | 85 | 53 | 0.7763 |
| Precept MC Lady | 1 | 432 | 1.681 | 1.515 | 81 | 65 | 0.7960 |
| Slazenger 408dr Raw Distance 3 | 1 | 408 | 1.680 | 1.500 | 106 | 68 | 0.8012 |

Figure 2:
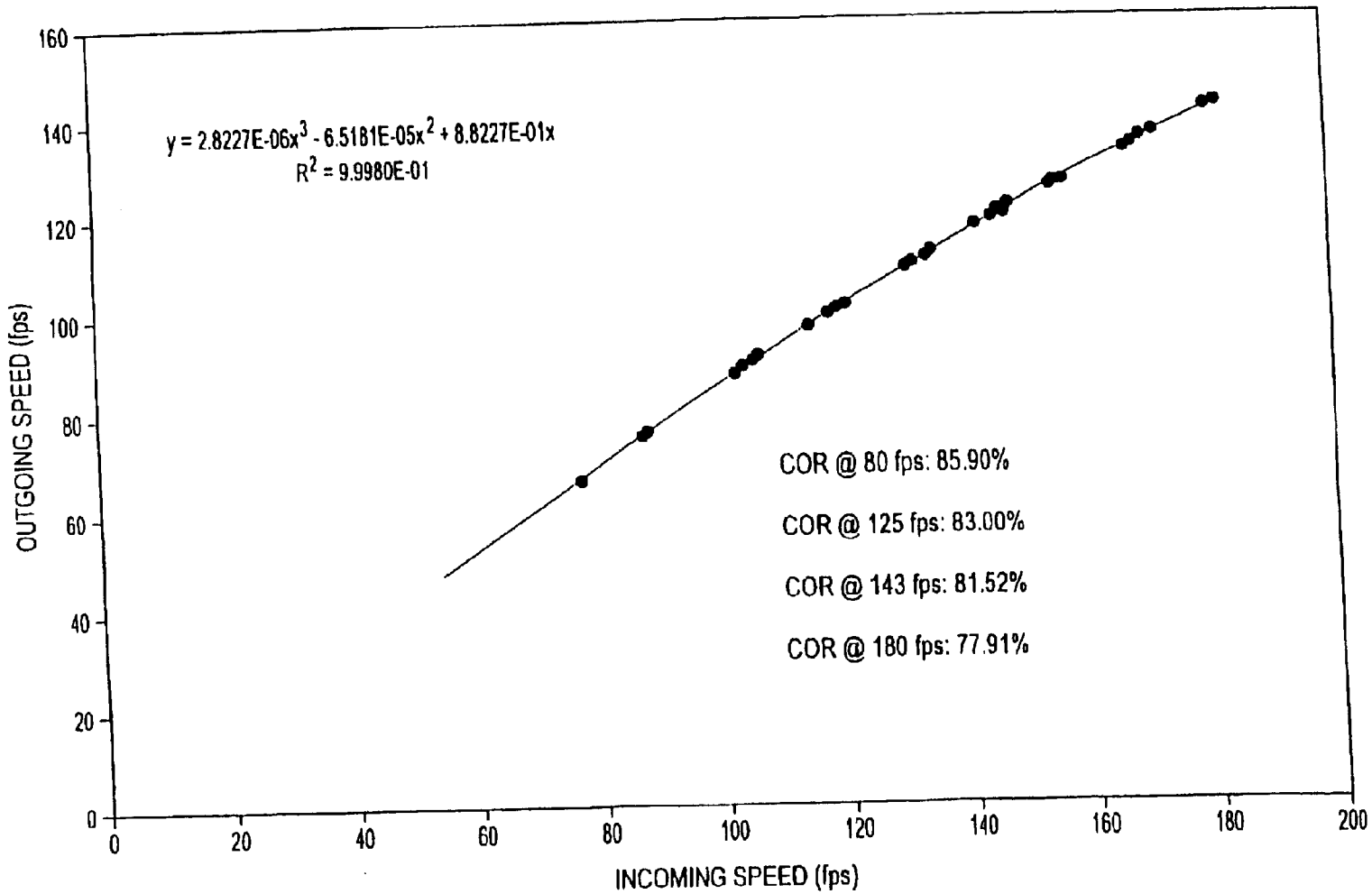
FIG. 2 is a graph of the outgoing speed (y-axis) versus the incoming speed (x-axis) to demonstrate the curve fitting operation for determining the COR of the golf ball of the present invention.
Figure 3:
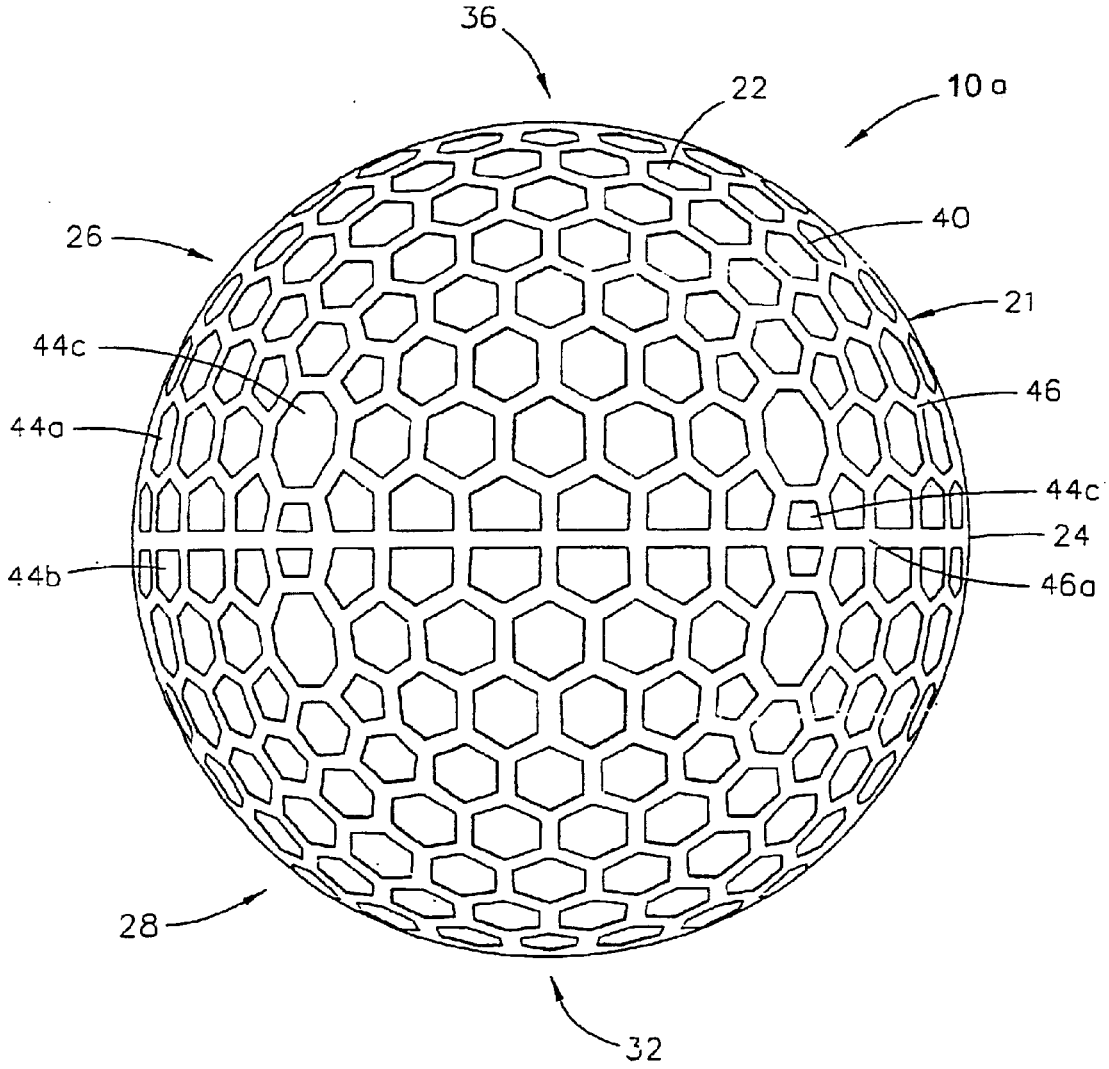
FIG. 3 is an equatorial view of a golf ball of the present invention.
Figure 4:
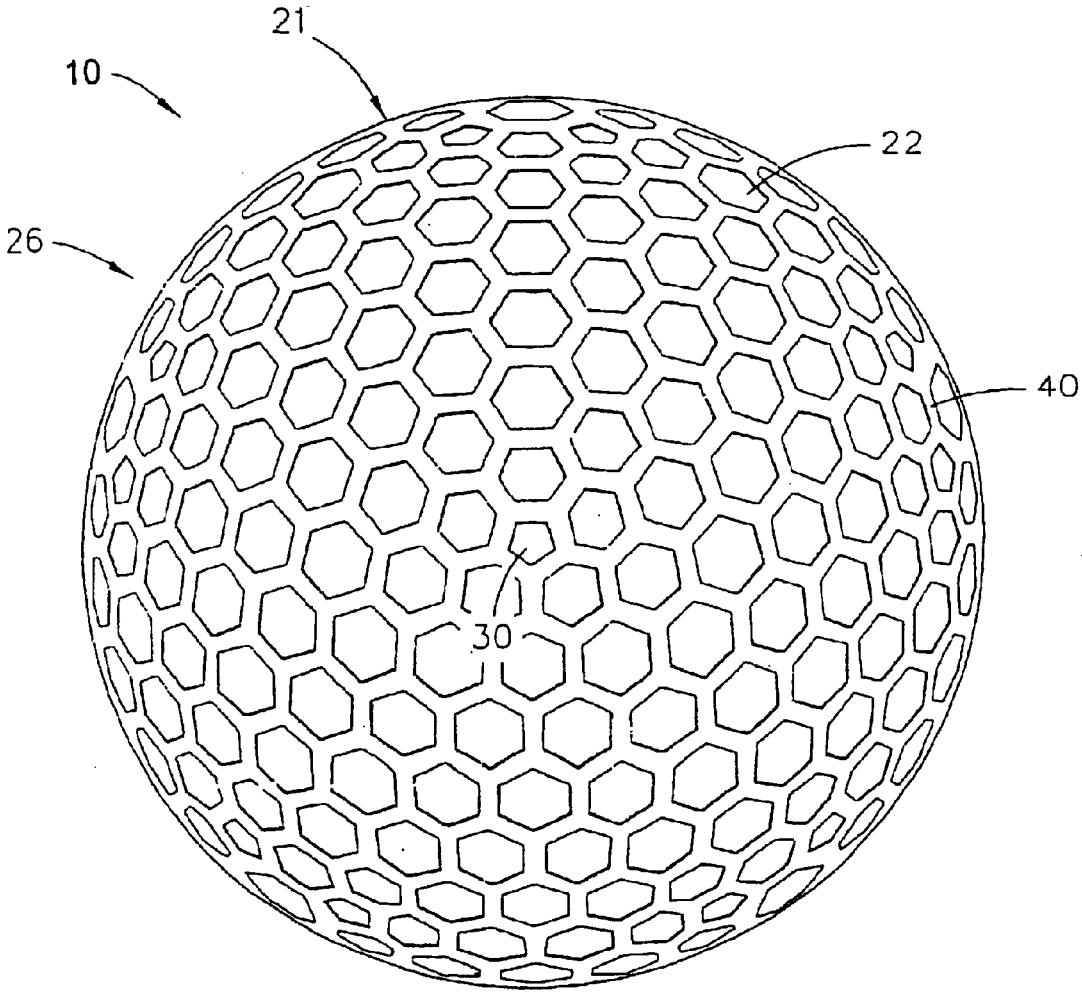
FIG. 4 is a polar view of the golf ball of the FIG. 3.
Figure 5:
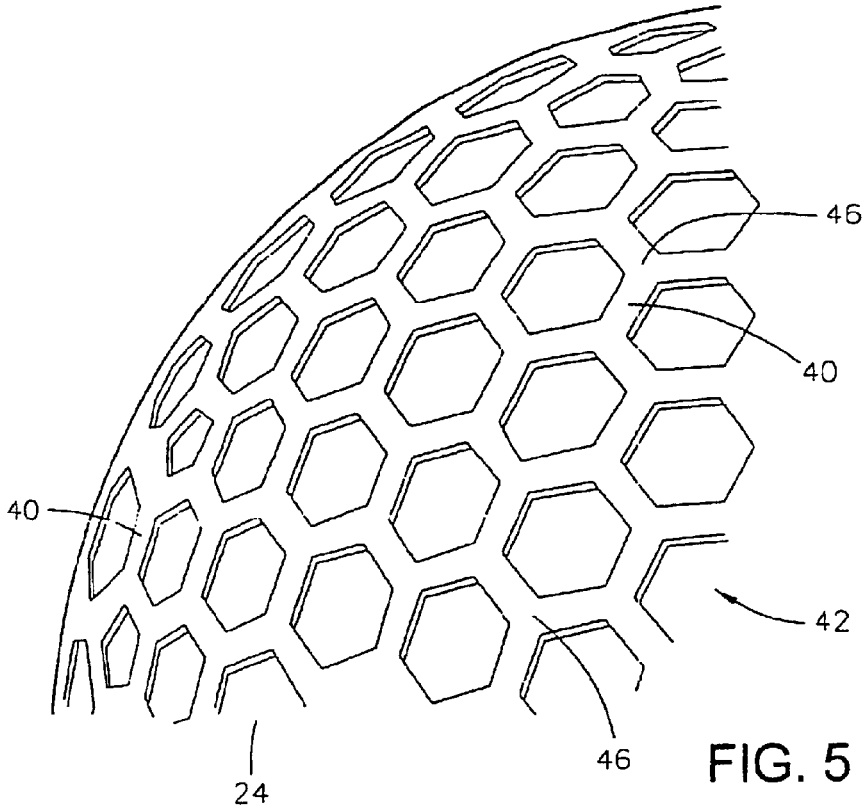
FIG. 5 is an enlargement of a section of FIG. 3.

Table Three illustrates the COR calculation of ten exemplary golf balls 10 of the present invention. The surface geometry of these exemplary golf balls 10 includes 382 dimples arranged as described in U.S. Pat. No. 6,224,499. The four columns are the COR at speeds of 80 feet per second, 125 feet per second, 143 feet per second and 180 feet per second. The COR at 143 feet per second for each of the golf balls 10 of the present invention is at least 0.8115, and most have a COR over 0.815. FIG. 2 illustrates the curve fitting operation that generated the numbers for Table Three.

TABLE THREE

| | COR | | | |
|---|---|---|---|---|
| Ball | 80 | 125 | 143 | 180 |
| 1. | 86.59% | 83.26% | 81.53% | 77.26% |
| 2. | 86.22% | 83.19% | 81.51% | 77.23% |
| 3. | 86.54% | 83.55% | 81.94% | 77.9% |
| 4. | 86.26% | 83.34% | 81.81% | 78.02% |
| 5. | 86.31% | 83.03% | 81.34% | 77.22% |
| 6. | 85.62% | 82.68% | 81.15% | 77.33% |
| 7. | 86.41% | 83.16% | 81.59% | 77.9% |
| 8. | 85.9% | 83.% | 81.52% | 77.91% |
| 9. | 86.46% | 83.22% | 81.61% | 77.73% |
| 10. | 85.08% | 80.66% | 78.65% | 74.09% |

Table Four illustrates the properties of the ten exemplary golf balls 10 of Table Three. Each of the ten golf balls has a solid polybutadiene core 12, an intermediate layer 16 composed of a blend of ionomers, and a thermosetting polyurethane cover 14 having a thickness of 0.020 inch. The PGA compression of the cores 12 of each of the ten golf balls 10 varies from 90 to 100 points. The diameter of each of the cores 12 varies from 1.490 inches to 1.515 inches. The thickness of each of the intermediate layers 16 varies from 0.0525 inch to 0.75 inch. The cover material is a cast thermosetting polyurethane (CTPU), and the cover hardness is the hardness of the material measured on a plaque according to ASTM D-2290, as opposed to the ball hardness, which is measured on the ball.

TABLE FOUR

| Ball | Core Comp. | Core Diameter | Inter. Thickness | Cover Material | Cover Hardness | Cover Thickness |
|---|---|---|---|---|---|---|
| 1 | 90 | 1.515 | .0625 | CTPU | 45 D | 0.020 |
| 2 | 90 | 1.490 | .075 | CTPU | 45 D | 0.020 |
| 3 | 100 | 1.515 | .0625 | CTPU | 45 D | 0.020 |
| 4 | 100 | 1.490 | .075 | CTPU | 45 D | 0.020 |
| 5 | 90 | 1.515 | .0625 | CTPU | 60 D | 0.020 |
| 6 | 90 | 1.490 | .075 | CTPU | 60 D | 0.020 |
| 7 | 100 | 1.515 | .0625 | CTPU | 60 D | 0.020 |
| 8 | 100 | 1.490 | .075 | CTPU | 60 D | 0.020 |
| 9 | 90 | 1.490 | .075 | CTPU | 45 D | 0.020 |
| 10 | 70 | 1.515 | .0525 | CTPU | 53 D | 0.030 |

Although the ten exemplary golf balls shown in Tables Three and Four have a dimple pattern, the golf ball 10 of the present invention preferably has a non-dimpled surface geometry. As shown in FIGS. 3–6, the golf ball 10 has an innersphere 21 with an innersphere surface 22. The golf ball 10 also has an equator 24 dividing the golf ball into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

Descending toward the surface 22 of the innersphere 21 are a plurality of lattice members 40. In a preferred embodiment, the lattice members 40 are tubular, however, those skilled in the pertinent art will recognize that the lattice members 40 may have other similar shapes. The lattice members 40 are connected to each other to form a lattice structure 42 on the golf ball 10. The interconnected lattice members 40 form a plurality of polygons encompassing discrete areas of the surface 22 of the innersphere 21. Most of these discrete bounded areas 44 are hexagonal shaped bounded areas 44*a*, with a few pentagonal shaped bounded areas 44*b*, a few octagonal shaped bounded areas 44*c*, and a few quadragonal shaped bounded areas 44*d*. In the embodiment of FIGS. 3–6, there are 380 polygons. In the preferred embodiment, each of the plurality of lattice members 40 are connected to at least another lattice member 40. Each of the lattice members 40 meets at least two other lattice members 40 at a vertex 46. Most of the vertices 46 are the congruence of three lattice members 40, however, some vertices 46*a* are the congruence of four lattice members 40. These vertices 46*a* are located at the equator 24 of the golf ball 10. The length of each of the lattice members 40 ranges from 0.005 inch to 0.01 inch, thereby defining an outersphere of at least 1.68 inches.

The preferred embodiment of the present invention has reduced the land to almost zero, since only a line of each of the plurality of lattice members 40 is in a spherical plane at 1.68 inches, the outersphere. More specifically, the land area of traditional golf balls is the area forming a sphere of at least 1.68 inches for USGA and R&A conforming golf balls. This land area is traditionally minimized with dimples that are concave into the surface of the sphere of the traditional golf ball, resulting in land area on the non-dimpled surface of the golf ball. However, the golf ball 10 of the present invention has only a line at an apex 50 of each of the lattice members 40 that defines the land area of the outersphere of the golf ball 10.

Traditional golf balls were designed to have the dimples "trip" the boundary layer on the surface of a golf ball in flight to create a turbulent flow for greater lift and reduced drag. The golf ball 10 of the present invention has the lattice structure 42 to trip the boundary layer of air about the surface of the golf ball 10 in flight.

Figure 6:
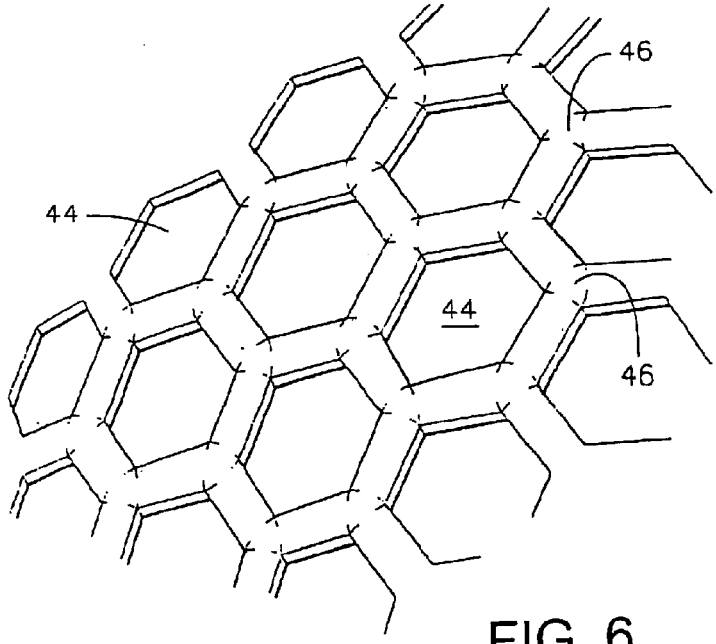
FIG. 6 is an enlargement of a section of FIG. 5.
Figure 6A:
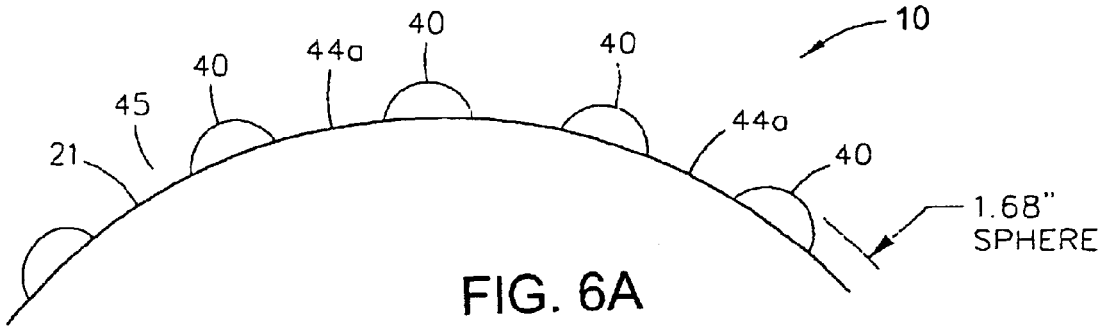
FIG. 6A is a cross-sectional view of the surface of the golf ball of the present invention illustrating an outersphere, also referred to as a phantom sphere.

As shown in FIG. 6A, a 1.68 inches outersphere, as shown by dashed line 45, encompasses the lattice members 40 and the innersphere 21. The volume of the lattice structure 42 as measured from the bottom of each lattice member 40 to the apex 50 is a minimal amount of the volume between 1.68 inches outersphere 45 and the innersphere 21. In the preferred embodiment, the apex 50 lies on the 1.68 inches outersphere 45. Thus, over 90 percent, and closer to 95 percent, of the entire volume of the golf ball 10 lies below the 1.68 inches outersphere 45.

Figure 7:
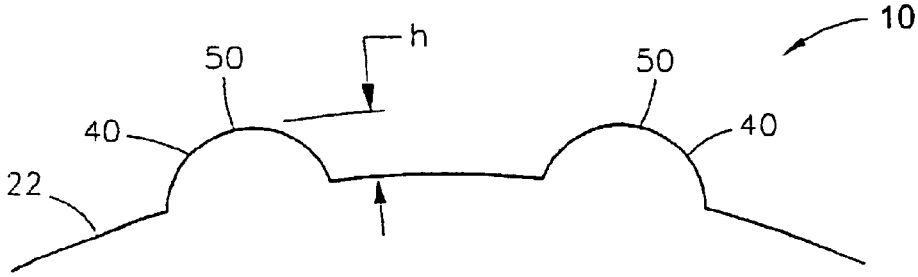
FIG. 7 is a cross-sectional view of one embodiment of lattice members of the golf ball of the present invention.
Figure 8:
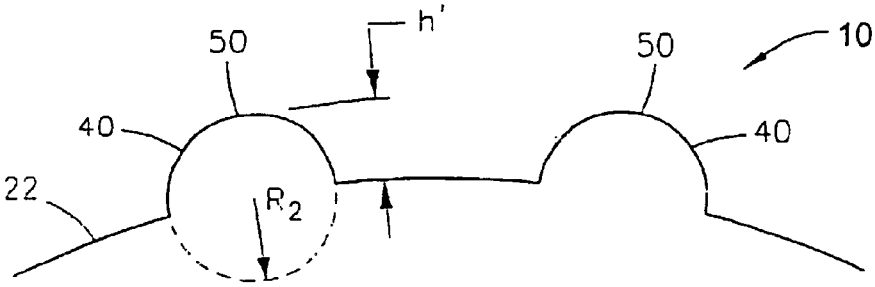
FIG. 8 is a cross-sectional view of an alternative embodiment of lattice members of the golf ball of the present invention.
Figure 8A:
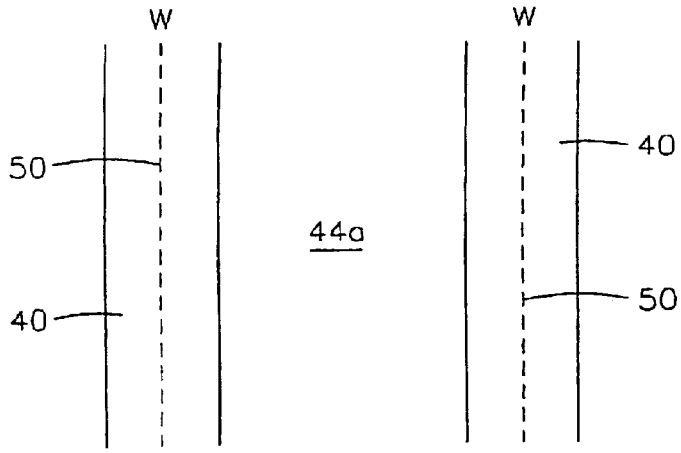
FIG. 8A is a top plan view of FIG. 8 to illustrate the width of the apex of each of the lattice members.

As shown in FIGS. 7 and 8, the distance h and h' of the lattice members 40 from the bottom of each lattice member 40 to an apex 50 will vary in order to have the golf ball 10 meet or exceed the 1.68 inches requirement. For example, if the diameter of the innersphere 21 is 1.666 inches, then the distance h of the lattice members 40 in FIG. 7 is 0.007 inch, since the lattice member 40 on one hemisphere 26 is combined with the corresponding lattice member 40 on the second hemisphere 28 to reach the 1.68 inches requirement. In a preferred embodiment, if lattice members 40 having a greater distance h' are desired, such as in FIG. 8, then the innersphere 21 has a lesser diameter. Thus, the diameter of the innersphere 21 in FIG. 8 is 1.662 inches, while the distance h' of the lattice members 40 is 0.009 inch, thereby resulting in an outersphere with a diameter of 1.68 inches. As shown in FIG. 8A, the width of each of the apices 50 is minimal since the apex lies along an arc of a lattice member 40. In theory, the width of each apex 50 should approach the width of a line. In practice, the width of each apex 50 of each lattice member 40 is determined by the precision of the mold utilized to produce the golf ball 10. The precision of the mold is itself determined by the master used to form the mold. In practice, the width of each line ranges from 0.0001 inch to 0.001 inch.

Figure 9:
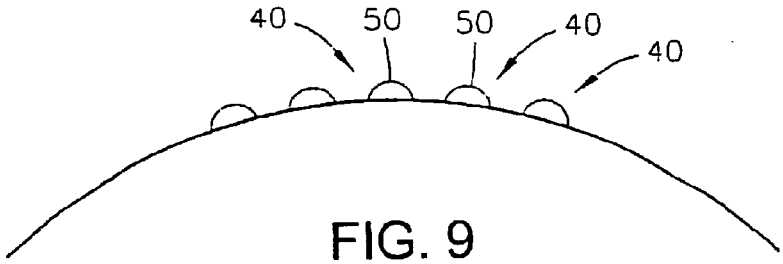
FIG. 9 is an isolated cross-sectional view of one embodiment of lattice members of the golf ball of the present invention.
Figure 10:
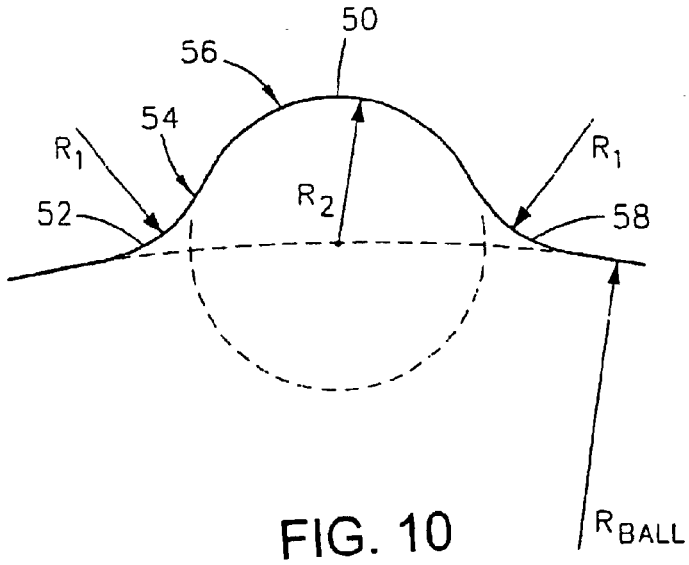
FIG. 10 is a cross-sectional view of a preferred embodiment of lattice members of the golf ball of the present invention.

Although in the cross-section of the lattice members 40 shown in FIGS. 7 and 8 are circular, a preferred cross-section of each of the plurality of lattice members 40 is shown in FIGS. 9 and 10. In such a preferred cross-section, the lattice member 40 has a contour 52 that has a first concave section 54, a convex section 56 and a second concave section 58. The radius $R_2$ of the convex portion 56 of each of the lattice members 40 is preferably in the range of 0.0275 inch to 0.0350 inch. The radius $R_1$ of the first and second concave portions 54 and 58 is preferably in the range of 0.150 inch to 0.200 inch, and most preferably 0.175 inch. $R_{IS}$ is the radius of the innersphere, which is preferably 0.831 inch. $R_{OS}$ is the radius of the outersphere, which is preferably 1.68 inches.

A preferred embodiment of the present invention is illustrated in FIGS. 11, 11A, 11B and 11C. In this embodiment, the golf ball 10 has a parting line 100 that corresponds to the shape of a polygon defined by the plurality of lattice members 40 about the equator 24. Thus, if the polygons have a hexagonal shape, the parting line 100 will alternate along the lower half of one hexagon and the upper half of an adjacent hexagon. Such a golf ball 10 is fabricated using a mold such as disclosed in co-pending U.S. patent application Ser. No. 09/442,845, filed on Nov. 18, 1999, entitled Mold For A Golf Ball, and incorporated herein by reference. The preferred embodiment allows for greater uniformity in the polygons. In the embodiment of FIGS. 11, 11A, 11B and 11C, there are 332 polygons, with twelve of those polygons being pentagons and the rest being hexagons.

Figure 11:
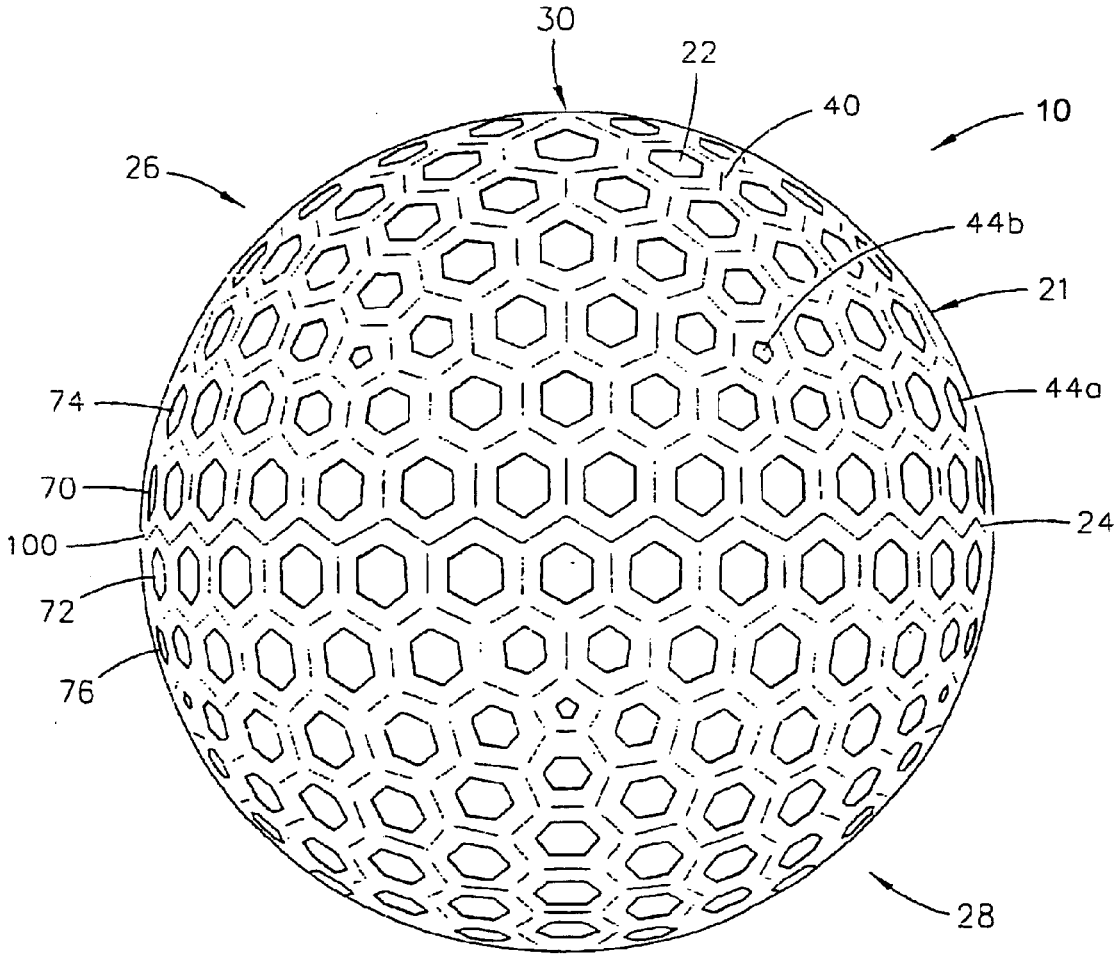
FIG. 11 is a front view of the preferred embodiment of the golf ball of the present invention illustrating the alternating parting line.
Figure 11A:
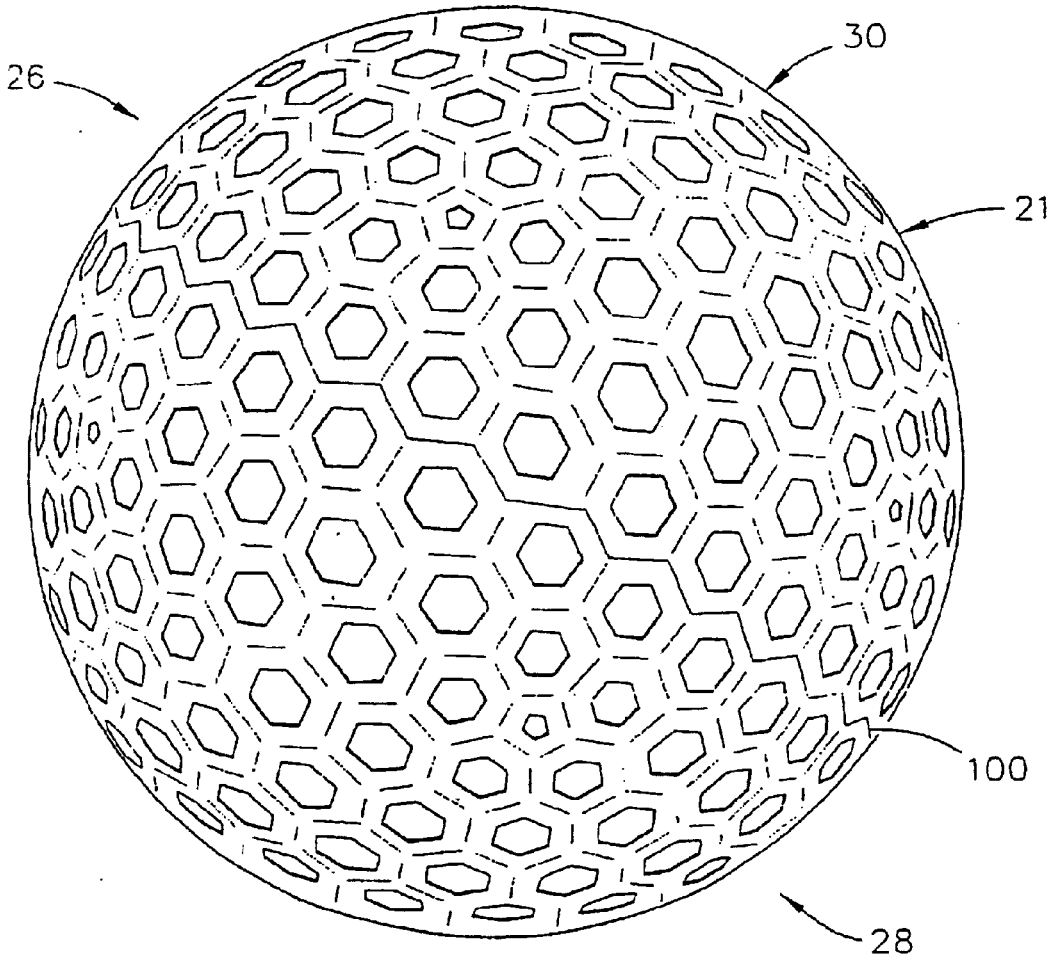
FIG. 11A is a perspective view of the golf ball of FIG. 11.
Figure 11B:
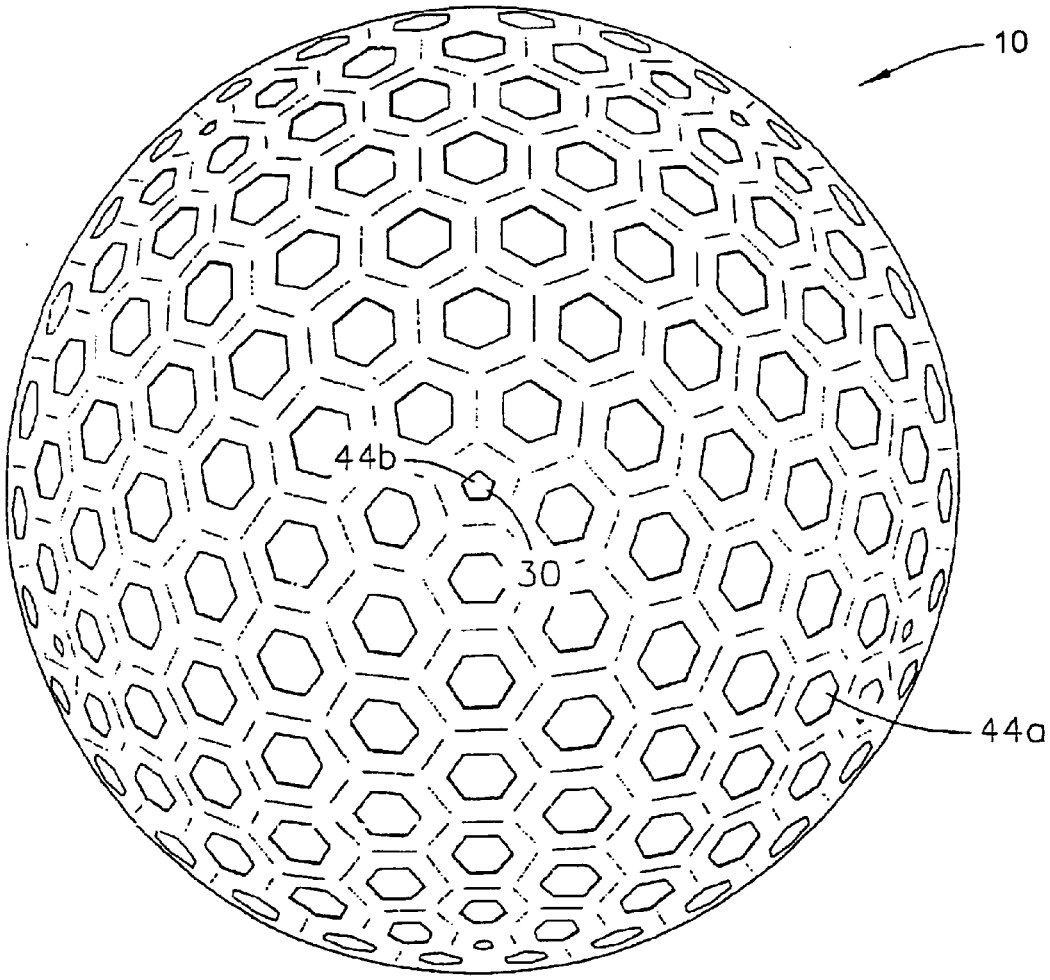
FIG. 11B is a polar view of the golf ball of FIG. 11.
Figure 11C:
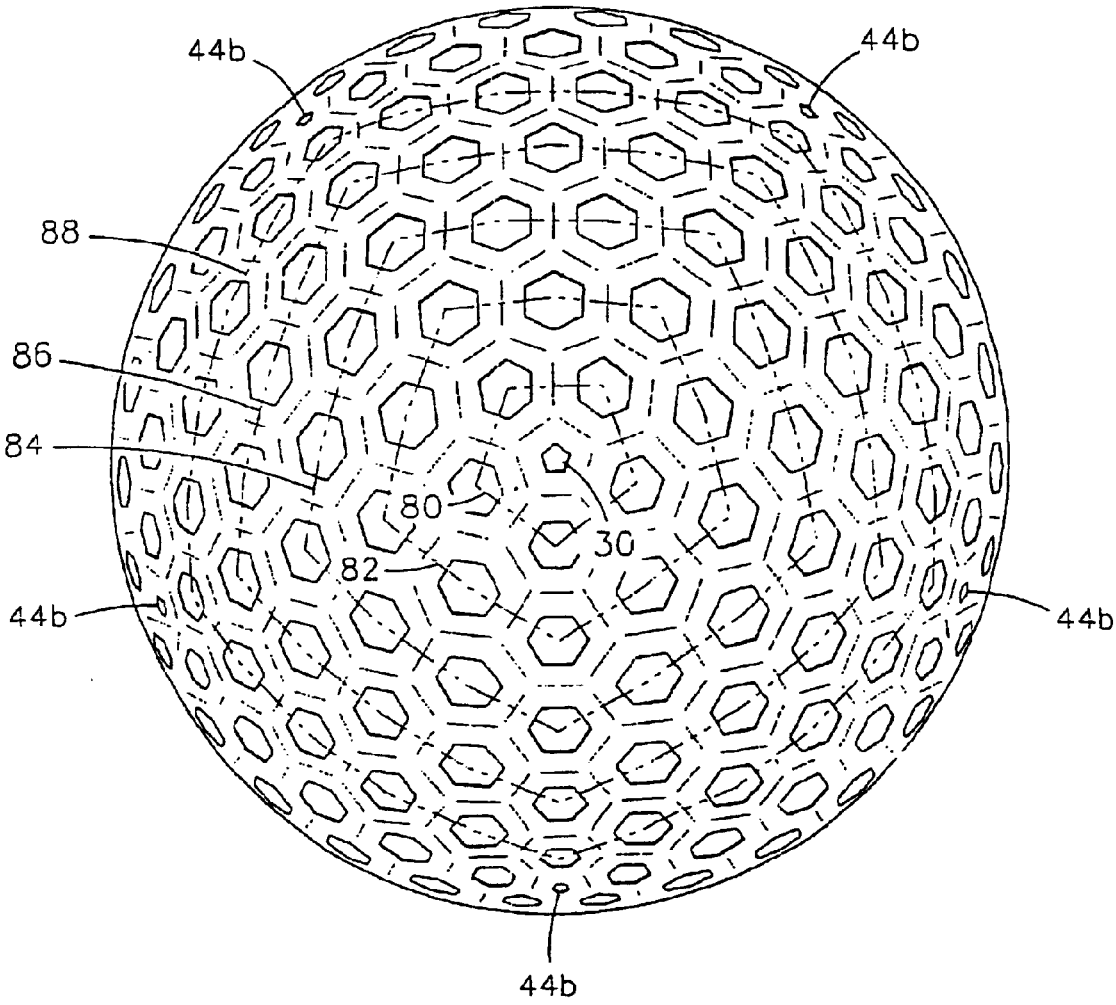
FIG. 11C is an identical view of FIG. 11 illustrating the pentagonal grouping of hexagons.

As shown in FIG. 11, each hemisphere 26 and 28 has two rows of hexagons 70, 72, 74 and 76, adjacent the parting line 100. The pole 30 of the first hemisphere 26 is encompassed by a pentagon 44*b*, as shown in FIG. 9B. The pentagon 44*b* at the pole 30 is encompassed by ever increasing spherical pentagonal groups of hexagons 80, 82, 84, 86, and 88. A pentagonal group 90 has pentagons 44*b* at each respective base, with hexagons 44*a* therebetween. The pentagonal groups 80, 82, 84, 86, 88 and 90 transform into the four adjacent rows 70, 72, 74 and 76. The preferred embodiment only has hexagons 44*a* and pentagons 44*b*.

Figure 12:
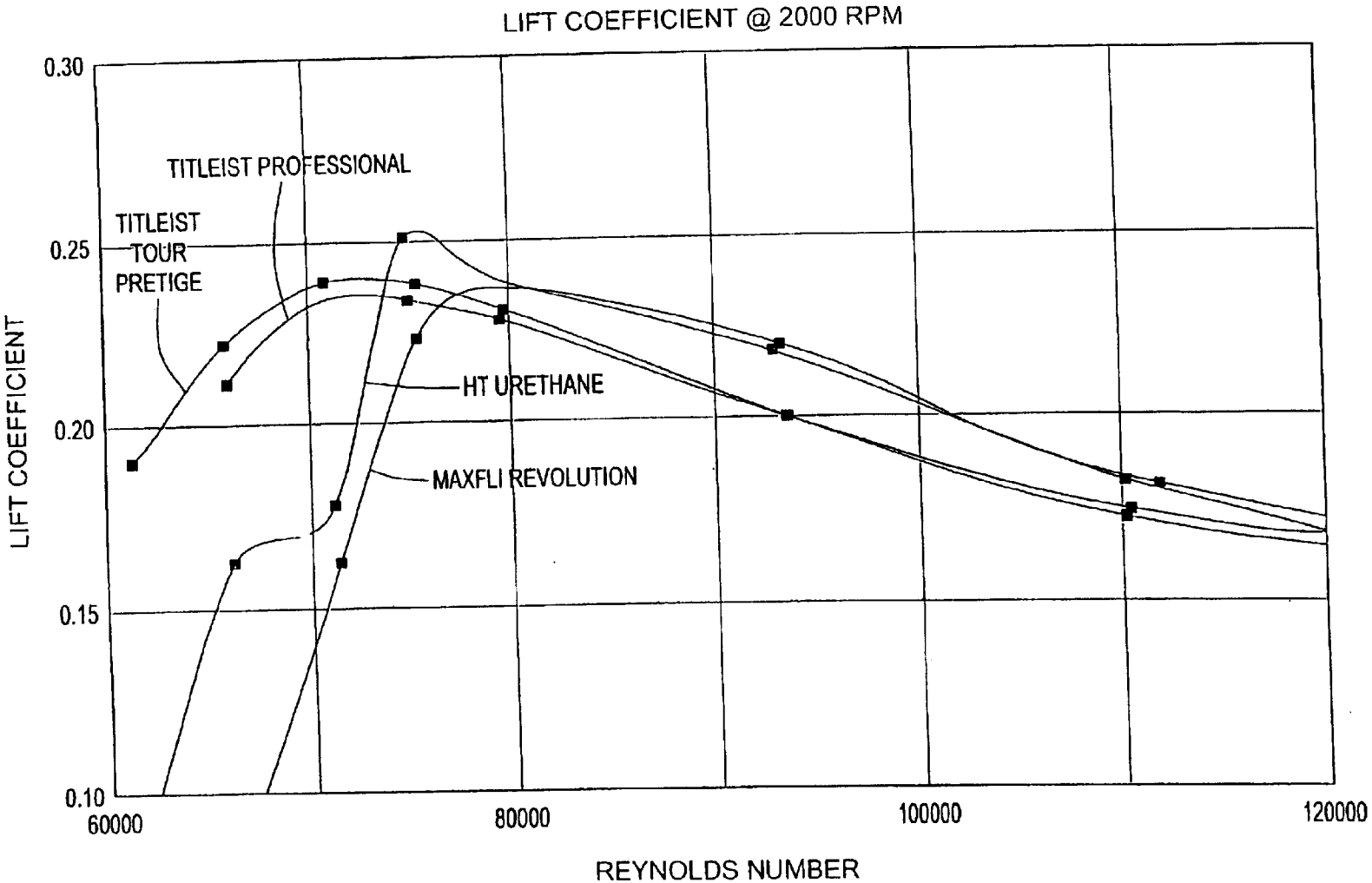
FIG. 12 is a graph of the lift coefficient versus Reynolds number for traditional golf balls.
Figure 13:
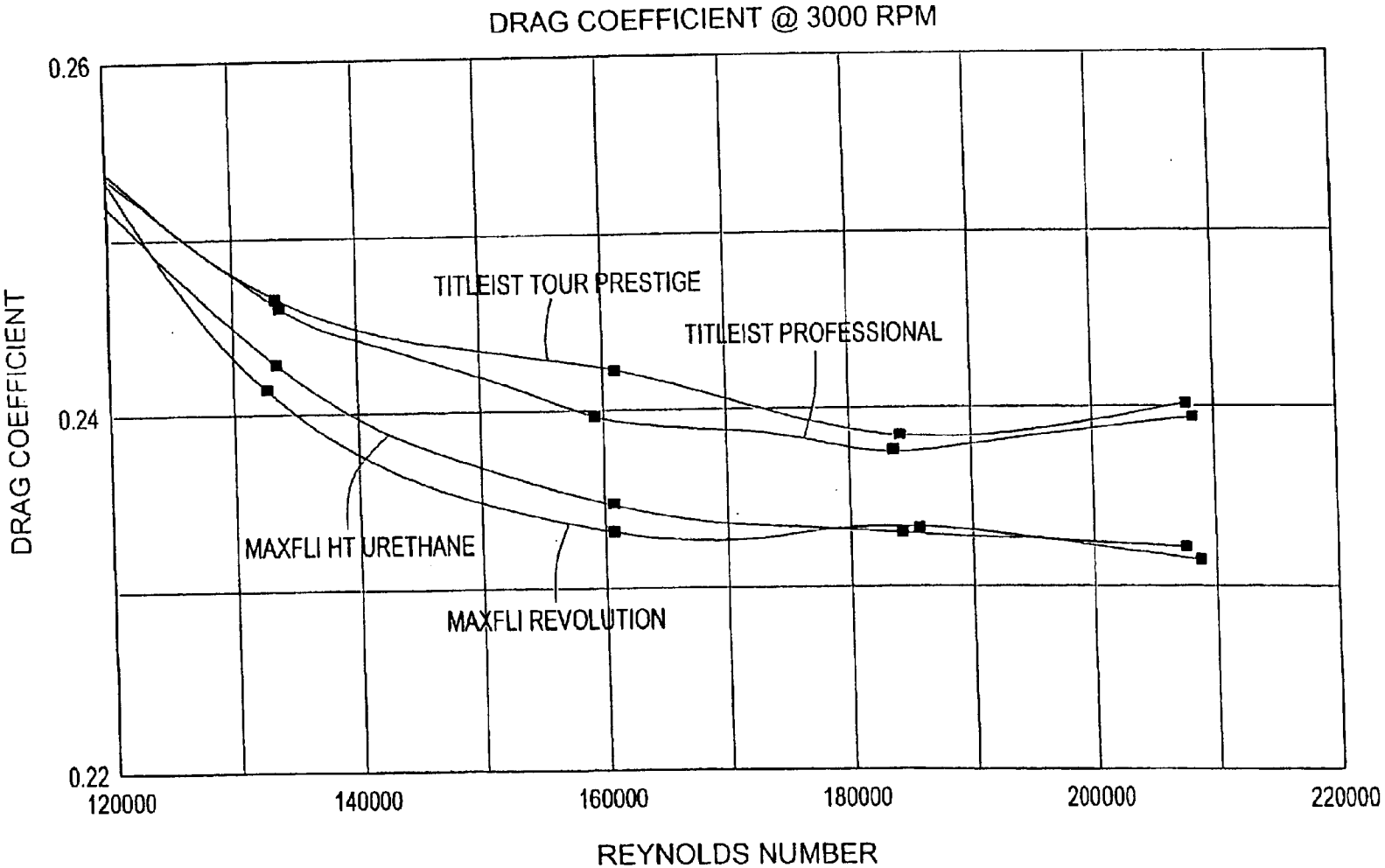
FIG. 13 is a graph of the drag coefficient versus Reynolds number for traditional golf balls.
Figure 14:
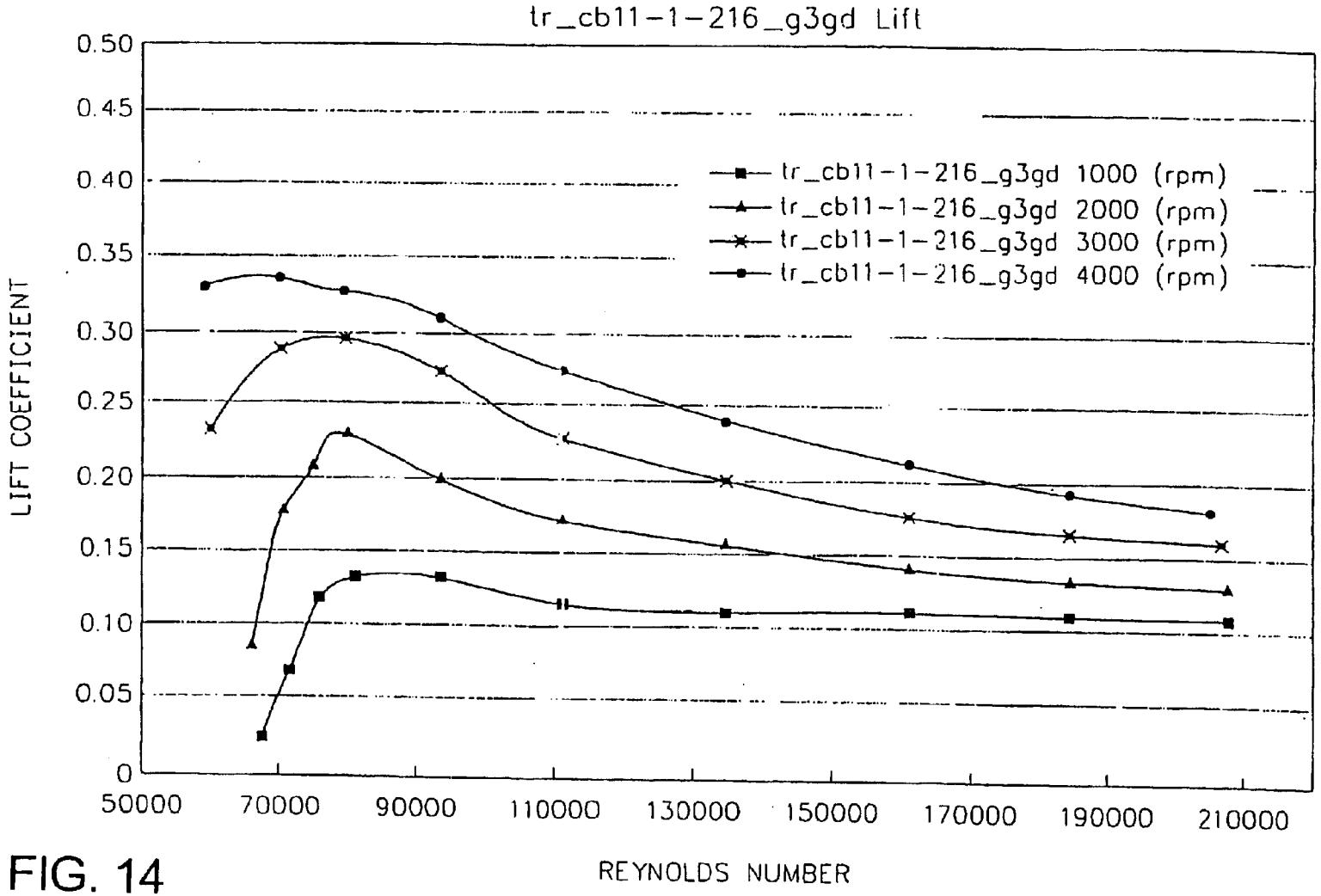
FIG. 14 is a graph of the lift coefficient versus Reynolds number for the golf ball of the present invention for four different backspins.
Figure 15:
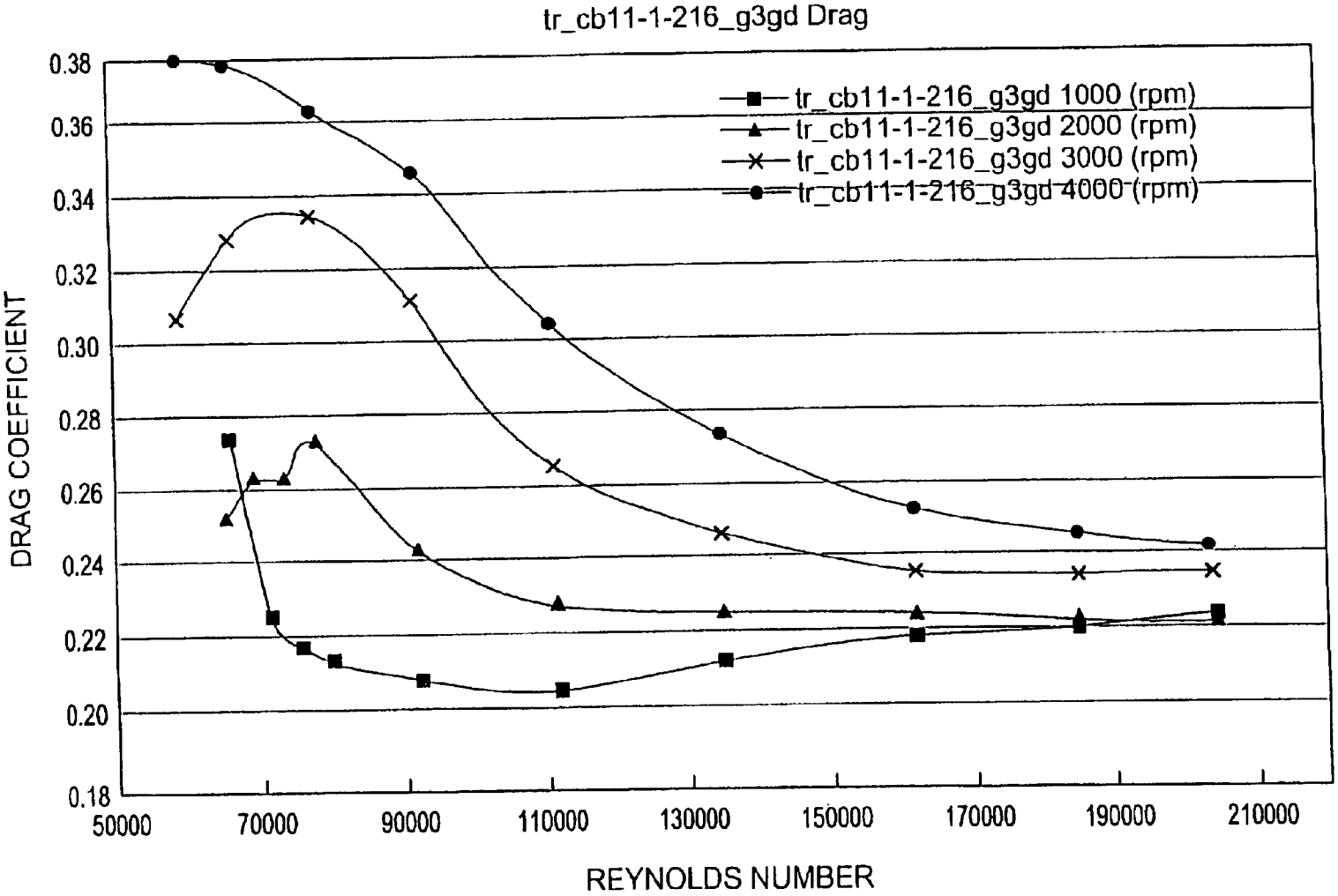
FIG. 15 is a graph of the drag coefficient versus Reynolds number for the golf ball of the present invention for four different backspins.

FIGS. 12 and 13 illustrate the lift and drag of traditional golf balls at a backspin of 2000 rpm and 3000 rpm, respectively. FIGS. 14 and 15 illustrate the lift and drag of the present invention at four different backspins. The force acting on a golf ball in flight is calculated by the following trajectory equation:

$$F=F_L+F_D+G \quad \text{(A)}$$

wherein F is the force acting on the golf ball; $F_L$ is the lift; $F_D$ is the drag; and G is gravity. The lift and the drag in equation A are calculated by the following equations:

$$F_L=0.5C_LA\rho v^2 \quad \text{(B)}$$

$$F_D=0.5C_DA\rho v^2 \quad \text{(C)}$$

wherein $C_L$ is the lift coefficient; $C_D$ is the drag coefficient; A is the maximum cross-sectional area of the golf ball; □ is the density of the air; and v is the golf ball airspeed.

The drag coefficient, $C_D$ and the lift coefficient, $C_L$ may be calculated using the following equations:

$$C_{D=2}F_{D/}A\rho v^2 \quad \text{(D)}$$

$$C_{L=2}F_{L/}A\rho v^2 \quad \text{(E)}$$

The Reynolds number R is a dimensionless parameter that quantifies the ratio of inertial to viscous forces acting on an object moving in a fluid. Turbulent flow for a dimpled golf ball occurs when R is greater than 40000. If R is less than 40000, the flow may be laminar. The turbulent flow of air about a dimpled golf ball in flight allows it to travel farther than a smooth golf ball.

The Reynolds number R is calculated from the following equation:

$$R=vD\rho/\mu \quad \text{(F)}$$

wherein v is the average velocity of the golf ball; D is the diameter of the golf ball (usually 1.68 inches); ρ is the density of air (0.00238 slugs/ft$^3$ at standard atmospheric conditions); and □ is the absolute viscosity of air ($3.74\times10^{-7}$ lb*sec/ft$^2$ at standard atmospheric conditions). A Reynolds number, R, of 180,000 for a golf ball having a USGA approved diameter of 1.68 inches, at standard atmospheric conditions, approximately corresponds to a golf ball hit from the tee at 200 ft/s or 136 mph, which is the point in time during the flight of a golf ball when the golf ball attains its highest speed. A Reynolds number, R, of 70,000 for a golf ball having a USGA approved diameter of 1.68 inches, at standard atmospheric conditions, approximately corresponds to a golf ball at its apex in its flight, 78 ft/s or 53 mph, which is the point in time during the flight of the golf ball when the travels at its slowest speed. Gravity will increase the speed of a golf ball after its reaches its apex.

FIG. 12 illustrates the lift coefficient of traditional golf balls such as the Titlelist PROFESSIONAL, the Titlelist TOUR PRESTIGE, the Maxfli REVOLUTION and the Maxfli HT URETHANE. FIG. 13 illustrates the drag coefficient of traditional golf balls such as the Titlelist PROFESSIONAL, the Titlelist TOUR PRESTIGE, the Maxfli REVOLUTION and the Maxfli HT URETHANE.

All of the golf balls for the comparison test, including the golf ball 10 of the present invention, have a thermoset polyurethane cover. The golf ball 10 of the present invention was constructed as set forth in U.S. Pat. No. 6,117,024, filed on Jul. 27, 1999, for a Golf Ball with a Polyurethane Cover which pertinent parts are hereby incorporated by reference. However, those skilled in the pertinent art will recognize that other materials may be used in the construction of the golf ball of the present invention. The aerodynamics of the lattice structure 42 of the present invention provides a greater lift with a reduced drag thereby translating into a golf ball 10 that travels a greater distance than traditional golf balls of similar constructions.

As compared to traditional golf balls, the golf ball 10 of the present invention is the only one that combines a lower drag coefficient at high speeds, and a greater lift coefficient at low speeds. Specifically, as shown in FIGS. 12 and 13, none of the other golf balls has a lift coefficient, $C_L$ greater than 0.18 at a Reynolds number of 70,000, and a drag coefficient $C_D$ less than 0.23 at a Reynolds number of 180,000. For example, while the Titliest PROFESSIONAL has a $C_L$ greater than 0.18 at a Reynolds number of 70,000, its $C_D$ is greater than 0.23 at a Reynolds number of 180,000. Also, while the Maxfli REVOLUTION has a drag coefficient $C_D$ greater than 0.23 at a Reynolds number of 180,000, its $C_L$ is less than 0.18 at a Reynolds number of 70,000.

In this regard, the Rules of Golf, approved by the USGA and the R&A, limit the initial velocity of a golf ball to 250 feet (76.2m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org or at the R&A web page at www.randa.org. Thus, the initial velocity and overall distance of a golf ball must not exceed these limits in order to conform to the Rules of Golf. Therefore, the golf ball 10 should have a dimple pattern that enables the golf ball 10 to meet, yet not exceed, these limits.

Figure 16:
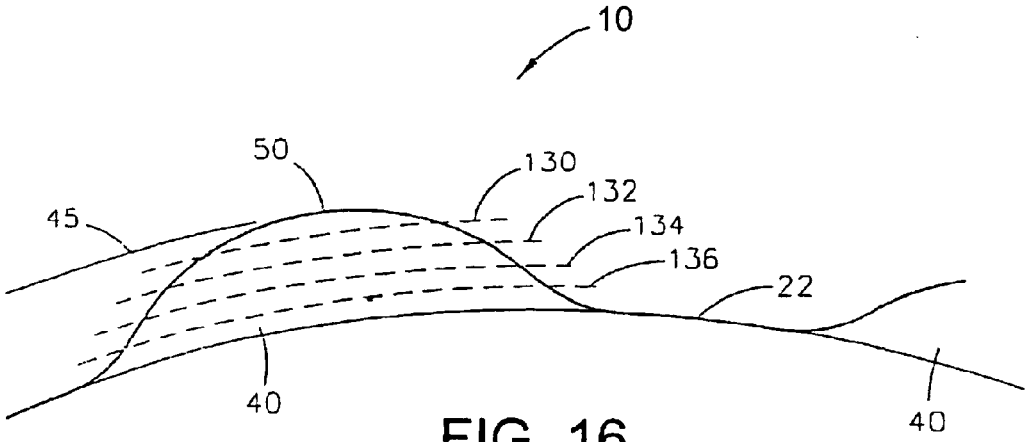
FIG. 16 is an enlarged view of the surface of a golf ball of the present invention to demonstrate the minimal volume feature of the present invention.

FIG. 16 is an enlarged view of the surface of the golf ball 10 of the present invention to demonstrate the minimal volume of the golf ball 10 from a predetermined distance from the greatest extent of the golf ball 10, the outersphere. More specifically, the greatest extent of one embodiment of the golf ball 10 are the apices 50 of the lattice members 40 which lie on a spherical plane (shown as dashed line 45) which has a 1.682 inches diameter, the outersphere. Those skilled in the art should recognize that other embodiments could have the apices 50 lie on a spherical plane at 1.70 inches, 1.72 inches, 1.64 inches, 1.60 inches, or any other variation in the diameter of the greatest extent of the golf ball 10. Having defined the greatest extent of the golf ball 10, the present invention will have a minimal volume from this greatest extent toward the innersphere 22. For example, dashed line 130 represents a spherical plane that intersects each of the lattice members 40 at a distance of 0.002 inch (at a radius of 0.839 inch from the center) from the greatest extent of the golf ball 10. The volume of the golf ball 10 of the present invention between the greatest extent spherical plane 45 and the spherical plane 130 is only 0.0008134 cubic inch. In other words, the outermost 0.002 inch (between a radius of 0.841 and 0.839 inch) of the golf ball 10 has a volume 0.0008134 cubic inch.

Figure 17:
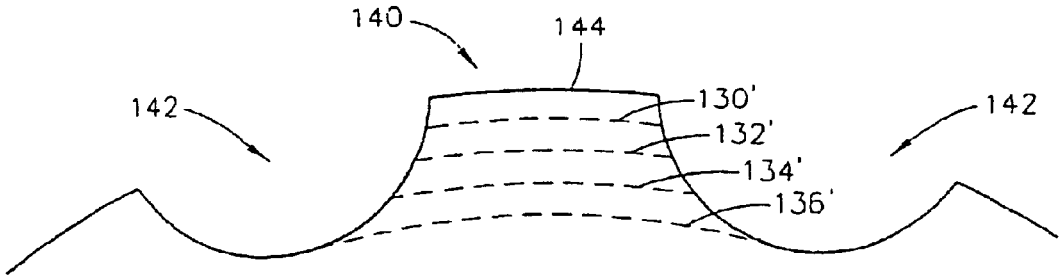
FIG. 17 (PRIOR ART)
FIG. 17 is an enlarged view of the surface of a golf ball of the prior art for comparison to the minimal volume feature of the present invention.
Figure 18:
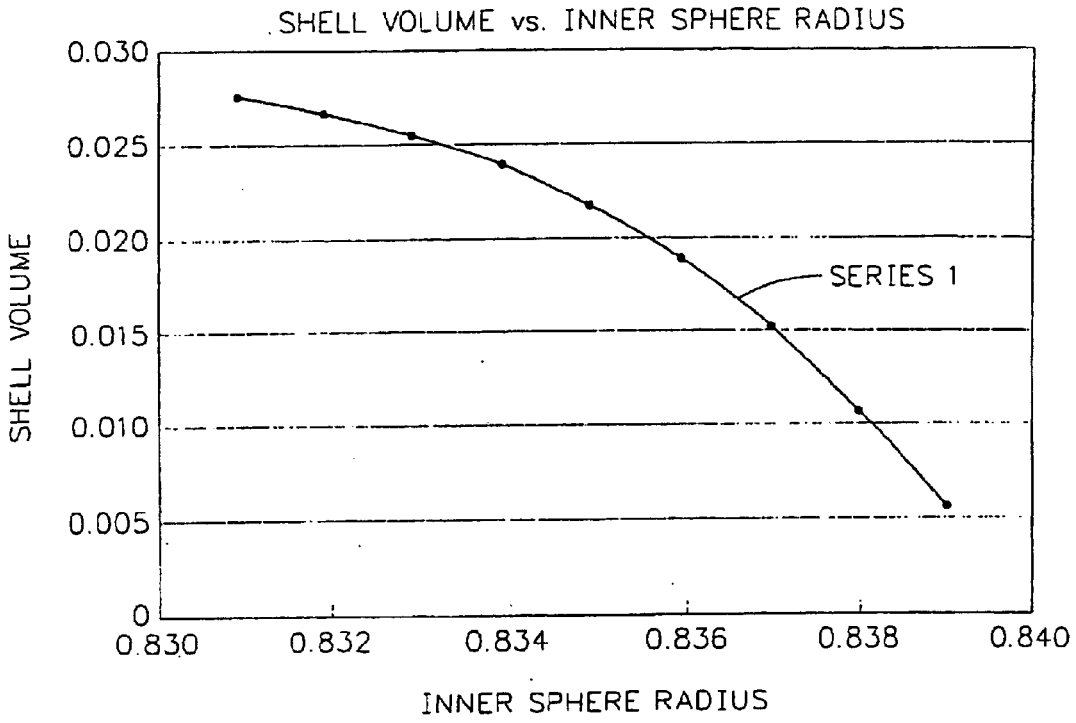
FIG. 18 is a chart of the minimal volume.

FIG. 17 illustrates the surface of a golf ball 140 of the prior art which has traditional dimples 142 encompassed by a land area 144. The land area 144 represents the greatest extent of the golf ball 140 of the prior art. For comparison to the golf ball 10 of the present invention, the volume of the golf ball 140 of the prior art between the greatest extent 144 and a spherical plane 130' is 0.00213 cubic inch. Spherical planes 132, 134 and 136, at 0.004 inch, 0.006 inch and 0.008 inch respectively, have volumes of 0.0023074 cubic inch, 0.0042164 cubic inch and 0.0065404 cubic inch, respectively on the golf ball 10 of the present invention. Spherical planes 132', 134' and 136', at 0.004 inch, 0.006 inch and 0.008 inch respectively, will have volumes of 0.00498 cubic inch, 0.00841 cubic inch and 0.01238 cubic inch on the golf ball 140 of the prior art 140. Thus, as further shown in FIG. 18 and Table Five below, the golf ball 10 of the present invention will have a minimal volume at a predetermined distance from the greatest extent of the golf ball 10. This minimal volume is a minimal amount necessary to trip the boundary layer air at low speed while providing a low drag level at high speeds. The first column of Table Five is the distance from the outermost point of the golf ball 10, which is the apex 50 of each of the lattice members 40. The second column is the individual volume of each of the 830 lattice members 40 at this distance inward from the outermost point. The third column is the total volume of the spherical planes at each distance inward from the outermost point. Table Six contains similar information for the golf ball 140 of the prior art.

TABLE FIVE

| Tube H | Tube Vol | Total Volume |
|---|---|---|
| 0.001 | 0.00000035 | 0.0002905 |
| 0.002 | 0.00000098 | 0.0008134 |
| 0.003 | 0.00000181 | 0.0015023 |
| 0.004 | 0.00000278 | 0.0023074 |
| 0.005 | 0.00000387 | 0.0032121 |
| 0.006 | 0.00000508 | 0.0042164 |
| 0.007 | 0.00000641 | 0.0053203 |
| 0.008 | 0.00000788 | 0.0065404 |
| 0.009 | 0.00001123 | 0.0093209 |

TABLE SIX

| Shell Delta Dia. | 1/10 Remaining Vol | Total Remaining Vol |
|---|---|---|
| 0.001 | 0.000091 | 0.00091 |
| 0.002 | 0.000213 | 0.00213 |
| 0.003 | 0.000347 | 0.00347 |
| 0.004 | 0.000498 | 0.00498 |
| 0.005 | 0.000663 | 0.00663 |
| 0.006 | 0.000841 | 0.00841 |
| 0.007 | 0.001033 | 0.01033 |
| 0.008 | 0.001238 | 0.01238 |
| 0.009 | 0.001458 | 0.01458 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a solid core composed of a polybutadiene blend and having a diameter in the range of 1.35 inches to 1.64 inches;

an intermediate layer disposed about the core; and a cover disposed over the intermediate layer, wherein the golf ball has an innersphere having a surface with a plurality of smooth portions, and a plurality of lattice members encompassing the plurality of smooth portions, each of the lattice members having a cross-sectional curvature including a first concave portion, a second concave portion, and a convex portion disposed between the first and second concave portions, each of the plurality of lattice members connected to at least one other lattice member to form a predetermined pattern of polygons about the plurality of smooth portions, and wherein the golf ball has a ball Shore D hardness ranging from 45 points to 75 points as measured on the surface of the golf ball, a coefficient of restitution greater than 0.7964 at 143 feet per second, and an USGA initial velocity less than 255.0 feet per second.

2. The golf ball according to claim 1 wherein each of the lattice members has an apex tangent to the curvature of the convex portion at a distance of from 0.005 inch to 0.010 inch from the bottom of the lattice member, the apices of the lattice members defining an outersphere.

3. The golf ball according to claim 2 wherein the apex of each of the plurality of lattice members has a width less than 0.001 inch.

4. The golf ball according to claim 2 wherein the diameter of the innersphere is at least 1.67 inches.

5. The golf ball according to claim 1 wherein the plurality of lattice members cover between 20% and 80% of the golf ball.

6. The golf ball according to claim 1 wherein each of the plurality of polygons is either a hexagon or a pentagon.

7. The golf ball according to claim 1 wherein the intermediate layer has a Shore D hardness ranging from 50 points to 75 points as measured on the curved surface of the intermediate layer.

8. The golf ball according to claim 1 further comprising a thread layer wound around the intermediate layer.

9. The golf ball according to claim 1 wherein the golf ball has a diameter of 1.68 inches to 1.70 inches.

10. The golf ball according to claim 1 wherein the cover is composed of a material selected from the group consisting of thermosetting polyurethane, thermoplastic polyurethane, ionomer, polyether amide, polybutadiene, and any mixture thereof.

11. The golf ball according to claim 1 wherein the core has a diameter in the range of 1.45 inches to 1.55 inches.

12. The golf ball according to claim 1 wherein the intermediate layer is composed of an ionomer blend of fifty parts of a sodium neutralized high acid methacrylic acid ionomer and fifty parts of a zinc neutralized high acid methacrylic acid.

13. A golf ball comprising:

a solid core composed of a polybutadiene blend and having a PGA compression ranging from 75 points to 120 points;

an intermediate layer disposed about the core, the intermediate layer having a Shore D hardness ranging from 50 points to 75 points as measured on the curved surface of the intermediate layer, the intermediate layer composed of a thermoplastic material; and a cover disposed over the intermediate layer, the cover composed of a thermosetting polyurethane material, wherein the golf ball has an innersphere having a surface with a plurality of smooth portions, and a plurality of lattice members encompassing the plurality of smooth portions, each of the lattice members having a cross-sectional curvature including a first concave portion, a second concave portion, and a convex portion disposed between the first and second concave portions, each of the plurality of lattice members connected to at least one other lattice member to form a predetermined pattern of polygons about the plurality of smooth portions, and wherein the golf ball has a ball Shore D hardness ranging from 45 points to 75 points as measured on the surface of the golf ball, a coefficient of restitution greater than 0.7964 at 143 feet per second, and an USGA initial velocity less than 255.0 feet per second.

14. The golf ball according to claim 13 wherein each of the lattice members has an apex tangent to the curvature of the convex portion at a distance of from 0.005 inch to 0.010 inch from the bottom of the lattice member, the apices of the lattice members defining an outersphere.

15. The golf ball according to claim 14 wherein the apex of each of the plurality of lattice members has a width less than 0.001 inch.

16. The golf ball according to claim 14 wherein the diameter of the innersphere is at least 1.67 inches.

17. The golf ball according to claim 13 wherein the plurality of lattice members cover between 20% and 80% of the golf ball.

18. The golf ball according to claim 13 wherein the golf ball has a coefficient of restitution greater than 0.8115 at 143 feet per second.

19. The golf ball according to claim 13 wherein the golf ball has a coefficient of restitution greater than 0.8150 at 143 feet per second.

20. A golf ball comprising:

a solid core composed of a polybutadiene blend, having a PGA compression ranging from 75 points to 120 points, and having a diameter ranging from 1.35 inches to 1.64 inches, the core having a mass ranging from about 32 grams to about 40 grams;

an intermediate layer disposed about the core and having a Shore D hardness ranging from 50 points to 75 points as measured on the curved surface of the intermediate layer, the intermediate layer composed of an ionomer material; and a cover disposed over the intermediate layer, the cover composed of a polyurethane material, the cover having a thickness ranging from 0.015 inch to 0.044 inch, wherein the golf ball has an innersphere having a surface with a plurality of smooth portions, and a plurality of lattice members encompassing the plurality of smooth portions, each of the lattice members having a cross-sectional curvature including a first concave portion, a second concave portion, and a convex portion disposed between the first and second concave portions, each of the plurality of lattice members connected to at least one other lattice member to form a predetermined pattern of polygons about the plurality of smooth portions, and wherein the golf ball has a ball Shore D hardness ranging from 50 points to 75 points as measured on the surface of the golf ball, a coefficient of restitution greater than 0.7964 at 143 feet per second, and an USGA initial velocity less than 255.0 feet per second.

21. The golf ball according to claim 20 wherein each of the lattice members has an apex tangent to the curvature of the convex portion at a distance of from 0.005 inch to 0.010 inch from the bottom of the lattice member, the apices of the lattice members defining an outersphere.

22. The golf ball according to claim 20 wherein the cover has a thickness ranging from 0.020 inch to 0.0375 inch.

23. The golf ball according to claim 20 wherein the cover has a thickness of approximately 0.030 inch.

24. The golf ball according to claim 20 wherein the core has a PGA compression ranging from 100 to 110 points.

25. The golf ball according to claim 20 wherein the golf ball has a coefficient of restitution greater than 0.8150 at 143 feet per second.

* * * * *